US010524542B2

(12) United States Patent
Avar

(10) Patent No.: US 10,524,542 B2
(45) Date of Patent: Jan. 7, 2020

(54) SOLE STRUCTURE WITH SIDE STIFFENER FOR ARTICLE OF FOOTWEAR

(71) Applicant: NIKE, Inc., Beaverton, OR (US)

(72) Inventor: Eric P. Avar, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 132 days.

(21) Appl. No.: 14/087,138

(22) Filed: Nov. 22, 2013

(65) Prior Publication Data

US 2015/0143720 A1 May 28, 2015

(51) Int. Cl.
*A43B 23/08* (2006.01)

(52) U.S. Cl.
CPC ..... *A43B 23/08* (2013.01)

(58) Field of Classification Search
CPC ..... A43B 23/04; A43B 23/08; A43B 23/0275; A43B 23/088; A43B 23/10; A43B 23/14; A43B 23/16; A43B 23/17; A43B 7/18; A43B 7/19; A43B 7/20; A43B 7/1495; A43B 23/0235; A43B 23/105; A43B 23/042; A43B 1/04; A43B 5/00; A43B 5/02; A43B 5/06; A43B 5/10; A43B 13/127
USPC ..... 36/68, 69, 107, 89, 90, 92, 114, 115, 36/126–130, 132, 100, 101
See application file for complete search history.

(56) References Cited

U.S. PATENT DOCUMENTS 248,616 A 10/1881 Shepard
479,251 A 7/1892 Dodge et al.
601,192 A 3/1898 Woodside
1,215,198 A 2/1917 Rothstein
1,597,934 A 8/1926 Stimpson
1,888,172 A 11/1932 Joha
1,902,780 A 3/1933 Holden et al.
1,910,251 A 5/1933 Joha
2,001,293 A 5/1935 Wilson
2,089,505 A 12/1935 Rivkin
2,047,724 A 7/1936 Zuckerman
2,147,197 A * 2/1939 Glidden ..... A43B 1/02 36/3 A (Continued)

FOREIGN PATENT DOCUMENTS

DE 870963 C 3/1953
DE 1084173 6/1960

(Continued)

OTHER PUBLICATIONS

Letter from Bruce Huffa dated Dec. 23, 2013 (71 Pages).

(Continued)

*Primary Examiner* — Anna K Kinsaul
*Assistant Examiner* — F Griffin Hall
(74) *Attorney, Agent, or Firm* — Brinks Gilson & Lione

(57) ABSTRACT

An article of footwear includes an upper having a knitted component formed of unitary knit construction. The knitted component also includes an external surface. Moreover, the footwear includes a sole structure that is coupled to the upper. The sole structure includes an intermediate member with a first surface. The first surface is attached to the external surface of the knitted component. The sole structure also includes at least one stiffener that is attached to the intermediate member. The intermediate member is disposed between the stiffener and the external surface of the knitted component.

20 Claims, 11 Drawing Sheets

(56) References Cited

U.S. PATENT DOCUMENTS 2,314,098 A 3/1943 McDonald
2,330,199 A 9/1943 Basch
2,343,390 A 3/1944 Ushakoff
2,400,692 A 5/1946 Herbert
2,440,393 A 4/1948 Clark
2,569,764 A 10/1951 Jonas
2,586,045 A 2/1952 Hoza
2,608,078 A 8/1952 Anderson
2,641,004 A 6/1953 Whiting et al.
2,675,631 A 4/1954 Doughty
2,994,322 A 8/1961 Cullen et al.
3,583,081 A 6/1971 Hayashi
3,694,940 A 10/1972 Stohr
3,704,474 A 12/1972 Winkler
3,766,566 A 10/1973 Tadakoro
3,778,856 A 12/1973 Christie et al.
3,925,912 A 12/1975 Martineau
3,952,427 A 4/1976 Von den Benken et al.
3,972,086 A 8/1976 Belli et al.
4,027,402 A 6/1977 Liu et al.
4,031,586 A 6/1977 Von den Benken et al.
4,107,857 A 8/1978 Devlin
4,211,806 A 7/1980 Civardi et al.
4,232,458 A 11/1980 Bartels
4,255,949 A 3/1981 Thorneburg
4,258,480 A 3/1981 Famolare, Jr.
4,317,292 A 3/1982 Melton
4,373,361 A 2/1983 Thorneburg
4,402,146 A * 9/1983 Parracho ..... A43B 23/17 36/129
4,447,967 A 5/1984 Mortara
4,465,448 A 8/1984 Aldridge
4,484,397 A * 11/1984 Curley, Jr. ..... A43B 23/17 36/132
4,607,439 A 8/1986 Harada
4,737,396 A 4/1988 Kamat
4,750,339 A 6/1988 Simpson et al.
4,756,098 A 7/1988 Boggia
4,785,558 A 11/1988 Shiomura
4,813,158 A 3/1989 Brown
4,854,055 A * 8/1989 Sugiyama ..... A43B 23/17 36/127
4,866,861 A * 9/1989 Noone ..... A43B 5/001 36/127
4,947,560 A * 8/1990 Fuerst ..... A43B 23/08 36/114
5,031,423 A 7/1991 Ikenaga
5,095,720 A 3/1992 Tibbals, Jr.
5,117,567 A 6/1992 Berger
5,152,025 A 10/1992 Hirmas
5,192,601 A 3/1993 Neisler
5,224,280 A * 7/1993 Preman ..... A43B 13/181 36/107
5,279,051 A * 1/1994 Whatley ..... A43B 13/181 36/114
D347,318 S * 5/1994 Avar ..... D2/947
5,313,717 A * 5/1994 Allen ..... A43B 13/20 36/153
5,345,638 A 9/1994 Nishida
5,353,524 A 10/1994 Brier
5,371,957 A 12/1994 Gaudio
5,461,884 A 10/1995 McCartney et al.
5,465,509 A * 11/1995 Fuerst ..... A43B 5/00 36/114
5,511,323 A 4/1996 Dahlgren
5,572,860 A 11/1996 Mitsumoto et al.
5,575,090 A 11/1996 Condini
5,623,840 A 4/1997 Roell
5,729,918 A 3/1998 Smets
5,732,483 A 3/1998 Cagliari
5,735,145 A 4/1998 Pernick
5,746,013 A 5/1998 Fay, Sr.
5,765,296 A 6/1998 Ludemann et al.
5,845,420 A * 12/1998 Buccianti ..... A43B 13/14 36/25 R
5,852,887 A 12/1998 Healy et al.
5,884,419 A 3/1999 Davidowitz et al.
5,896,683 A * 4/1999 Foxen ..... A43B 7/20 36/89
5,996,189 A 12/1999 Wang
6,000,148 A 12/1999 Cretinon
6,029,376 A 2/2000 Cass
6,032,387 A 3/2000 Johnson
6,052,921 A 4/2000 Oreck
6,088,936 A 7/2000 Bahl
6,151,802 A 11/2000 Reynolds
6,170,175 B1 1/2001 Funk
6,308,438 B1 10/2001 Throneburg et al.
6,333,105 B1 12/2001 Tanaka et al.
6,401,364 B1 6/2002 Burt
6,401,366 B2 * 6/2002 Foxen ..... A43B 13/14 36/102
6,438,870 B2 * 8/2002 Nasako ..... A43B 13/181 36/103
6,497,058 B2 12/2002 Dietrich et al.
6,558,784 B1 5/2003 Norton et al.
6,588,237 B2 7/2003 Cole et al.
6,754,983 B2 6/2004 Hatfield et al.
6,910,288 B2 6/2005 Dua
6,922,917 B2 8/2005 Kerns et al.
6,931,762 B1 8/2005 Dua
D517,297 S 3/2006 Jones et al.
7,051,460 B2 5/2006 Orei et al.
7,056,402 B2 6/2006 Koerwien et al.
7,299,567 B2 11/2007 Berend et al.
7,347,011 B2 2/2008 Dua et al.
7,441,348 B1 10/2008 Dawson
7,543,397 B2 6/2009 Kilgore et al.
7,568,298 B2 8/2009 Kerns
7,647,709 B2 * 1/2010 Reilly ..... A43B 7/142 36/107
7,682,219 B2 3/2010 Falla
7,698,835 B2 4/2010 Potter et al.
8,001,704 B2 * 8/2011 Baudouin ..... A43B 7/1495 36/102
8,302,233 B2 * 11/2012 Spanks ..... A43B 1/0072 12/142 F
8,327,560 B2 12/2012 Berend
8,490,299 B2 7/2013 Dua et al.
8,776,397 B2 * 7/2014 Borel ..... A43B 13/026 36/103
8,850,721 B2 * 10/2014 Long ..... A43B 5/12 36/107
2002/0020078 A1 2/2002 Bressoux et al.
2002/0078599 A1 6/2002 Delgorgue et al.
2002/0148258 A1 10/2002 Cole et al.
2003/0126762 A1 7/2003 Tseng
2003/0191427 A1 10/2003 Jay et al.
2004/0118018 A1 6/2004 Dua
2004/0154188 A1 * 8/2004 Laska ..... A43B 5/06 36/25 R
2004/0181972 A1 9/2004 Csorba
2004/0244226 A1 * 12/2004 Farys ..... A43B 5/003 36/140
2005/0115284 A1 6/2005 Dua
2005/0193592 A1 9/2005 Dua et al.
2005/0268491 A1 * 12/2005 McDonald ..... A43B 1/0063 36/28
2005/0273988 A1 12/2005 Christy
2005/0284000 A1 12/2005 Kerns
2006/0059715 A1 3/2006 Aveni
2006/0162187 A1 7/2006 Byrnes et al.
2007/0022627 A1 2/2007 Sokolowski et al.
2007/0137068 A1 * 6/2007 Fallon ..... A43B 3/24 36/101
2007/0180730 A1 8/2007 Greene et al.
2008/0017294 A1 1/2008 Bailey et al.
2008/0078102 A1 4/2008 Kilgore et al.
2008/0110048 A1 5/2008 Dua et al.
2008/0189830 A1 8/2008 Egglesfield

(56) References Cited

U.S. PATENT DOCUMENTS

| | | | | |
|---|---|---|---|---|
| 2008/0289220 | A1* | 11/2008 | Rivas | A43B 3/0036 36/88 |
| 2008/0313939 | A1 | 12/2008 | Ardill | |
| 2009/0068908 | A1 | 3/2009 | Hinchcliff | |
| 2009/0320330 | A1* | 12/2009 | Borel | A43B 13/026 36/30 R |
| 2010/0051132 | A1 | 3/2010 | Glenn | |
| 2010/0154256 | A1 | 6/2010 | Dua | |
| 2010/0170651 | A1 | 7/2010 | Scherb et al. | |
| 2010/0236096 | A1* | 9/2010 | Pauk | A43B 13/12 36/28 |
| 2010/0287792 | A1* | 11/2010 | Hide | A43B 5/10 36/114 |
| 2011/0030244 | A1 | 2/2011 | Motawi et al. | |
| 2011/0078921 | A1 | 4/2011 | Greene et al. | |
| 2011/0113650 | A1* | 5/2011 | Hurd | A43B 23/08 36/107 |
| 2011/0185592 | A1 | 8/2011 | Nishiwaki et al. | |
| 2011/0232130 | A1* | 9/2011 | Boudreau | A43B 13/141 36/88 |
| 2012/0233882 | A1 | 9/2012 | Huffa et al. | |
| 2012/0255201 | A1* | 10/2012 | Little | A43B 1/04 36/84 |
| 2012/0255205 | A1* | 10/2012 | Jensen | A43B 1/0027 36/25 R |
| 2012/0266496 | A1 | 10/2012 | Kosta | |
| 2012/0304491 | A1 | 12/2012 | Kimura et al. | |
| 2012/0311890 | A1* | 12/2012 | Berthet | A43B 5/0411 36/107 |
| 2013/0000150 | A1 | 1/2013 | Hurd et al. | |

FOREIGN PATENT DOCUMENTS

| | | | |
|---|---|---|---|
| DE | 19738433 | | 4/1998 |
| DE | 19728848 | | 1/1999 |
| EP | 0448714 | | 10/1991 |
| EP | 0728860 | | 8/1996 |
| EP | 0758693 | | 2/1997 |
| EP | 0279950 | A2 | 8/1998 |
| EP | 0898002 | A2 | 2/1999 |
| EP | 1233091 | | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| FR | 2171172 | | 9/1973 |
| GB | 538865 | | 8/1941 |
| GB | 2018837 | A | 10/1979 |
| GB | 1603487 | | 11/1981 |
| JP | H06113905 | | 4/1994 |
| JP | H08109553 | | 4/1996 |
| JP | H11302943 | | 11/1999 |
| JP | 2005-160697 | A | 6/2005 |
| NL | 7304678 | | 10/1974 |
| WO | 9003744 | | 4/1990 |
| WO | 0032861 | | 6/2000 |
| WO | 0231247 | | 4/2002 |

OTHER PUBLICATIONS

Declaration of Dr. Edward C. Frederick from the U.S. Patent and Trademark Office Inter Partes Review of U.S. Pat. No. 7,347,011 (178 pp).

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

International Search Report and Written Opinion in connection with PCT/US2009/056795 dated Apr. 20, 2010.

International Search Report and Written Opinion in connection with PCT/US2012/028576 dated Oct. 1, 2012.

International Search Report and Written Opinion in connection with PCT/US2012/028559 dated Oct. 19, 2012.

International Search Report and Written Opinion in connection with PCT/US2012/028534 dated Oct. 17, 2012.

International Preliminary Report on Patentability in connection with PCT/US2012/028534 dated Sep. 17, 2013.

International Preliminary Report on Patentability in connection with PCT/US2012/028576 dated Sep. 17, 2013.

International Search Report and Written Opinion for Application No. PCT/US2014/048096, dated Dec. 12, 2014.

Office Action and English translation of relevant portion of Chinese Application No. 2014800633746, dated Feb. 4, 2017, 21 pages.

International Preliminary Report on Patentability and Written Opinion for PCT/US2014/048096, dated May 24, 2016, 19 pages.

Office Action and English translation for corresponding ROC (Taiwan) Application No. 103135572, dated Jul. 22, 2016, 24 pages.

Office Action and English translation for corresponding ROC (Taiwan) Application No. 103135572, dated May 26, 2017, 4 pages.

Second Office Action and English translation of relevant portion of Chinese Application No. 2014800633746, dated Sep. 20, 2017, 2017, 32 pages.

Examination Report for corresponding EP 14753354.1 dated Dec. 6, 2018, 5 pages.

Office Action and English translation of Argentina Application No. P140104371, dated Aug. 14, 2019, 8 pages.

* cited by examiner

SOLE STRUCTURE WITH SIDE STIFFENER FOR ARTICLE OF FOOTWEAR

FIELD

The present disclosure relates to footwear and, more particularly, relates to a sole structure with a side stiffener for an article of footwear.

BACKGROUND

Articles of footwear typically include an upper and a sole structure. The upper can receive the wearer's foot and secure the footwear to the foot. Also, the sole structure can provide traction for the footwear. Moreover in some embodiments, the sole structure can be resiliently compressible to provide cushioning to the wearer's foot.

More specifically, the upper can include one or more sheet-like sections of material that define a cavity for receiving the wearer's foot. The upper can also include laces, straps, buckles, buttons, and other similar components for securing the footwear to the wearer's foot.

Also, the sole structure can include a midsole in some embodiments. The midsole can include resiliently compressible members, such as foam, a fluid-filled bladder, or other cushioning members. As such, the midsole can resiliently compress under the weight of the wearer or due to impact with a ground surface. This can help distribute the resulting loads across the sole structure and/or attenuate the loads to provide cushioning.

The sole structure can additionally include an outsole. The outsole can be made from relatively high friction material such that the outsole can readily grip the ground with firm traction. The outsole can also include grooves, sipes, recesses, or other features that increase surface area of the ground engaging surface, that can channel water away from the ground engaging surface, or otherwise increase such traction for the article of footwear.

SUMMARY

An article of footwear is disclosed. The footwear includes an upper having a knitted component formed of unitary knit construction. The knitted component also includes an external surface. Moreover, the footwear includes a sole structure that is coupled to the upper. The sole structure includes an intermediate member with a first surface. The first surface is attached to the external surface of the knitted component. The sole structure also includes at least one stiffener that is attached to the intermediate member. The intermediate member is disposed between the stiffener and the external surface of the knitted component.

An article of footwear is also disclosed that includes an upper with a first wall and a second wall. The first wall and the second wall area separated at a distance from each other to at least partially define a void that is configured to receive a foot. The article of footwear also includes a sole structure that is coupled to the upper. The sole structure includes at least one stiffener with a first portion and a second portion. The sole structure further includes an intermediate member with a first surface and a second surface. The first surface is attached to the upper. The second surface faces away from the first surface. The second surface includes an intermediate recess, and the intermediate recess receives the first portion of the stiffener. The first portion of the stiffener is attached to the intermediate member. Moreover, the sole structure includes a base member that extends between the first wall and the second wall of the upper. The base member includes a ground engaging surface. The second portion of the stiffener is attached to the base member.

Moreover, an article of footwear is disclosed that includes an upper and a sole structure that is coupled to the upper. The sole structure includes an intermediate member with a first surface and a second surface. The first surface is attached to the upper, and the second surface faces away from the upper. The sole structure also includes a first stiffener with a first inner surface and a first outer surface. The first inner surface is attached to the second surface of the intermediate member. The first outer surface faces away from the intermediate member. The sole structure further includes a second stiffener that includes a second inner surface and a second outer surface. The second inner surface is attached to the second surface of the intermediate member. The second outer surface faces away from the intermediate member. The first stiffener and the second stiffener are spaced apart from each other. The intermediate member includes an exposed portion that is exposed between the first stiffener and the second stiffener.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 15:
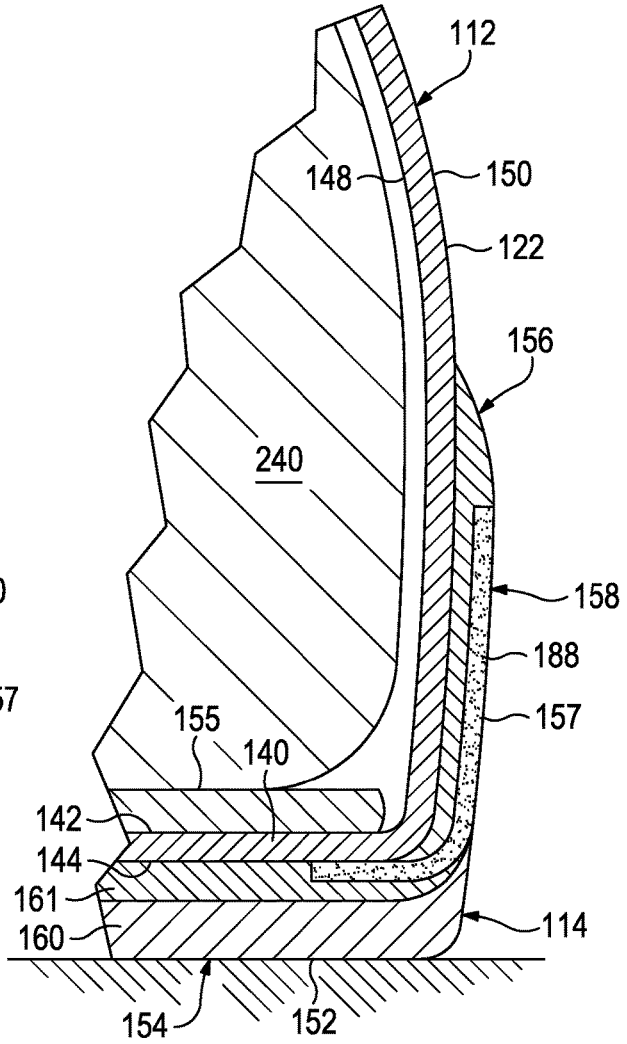
Figure 16:
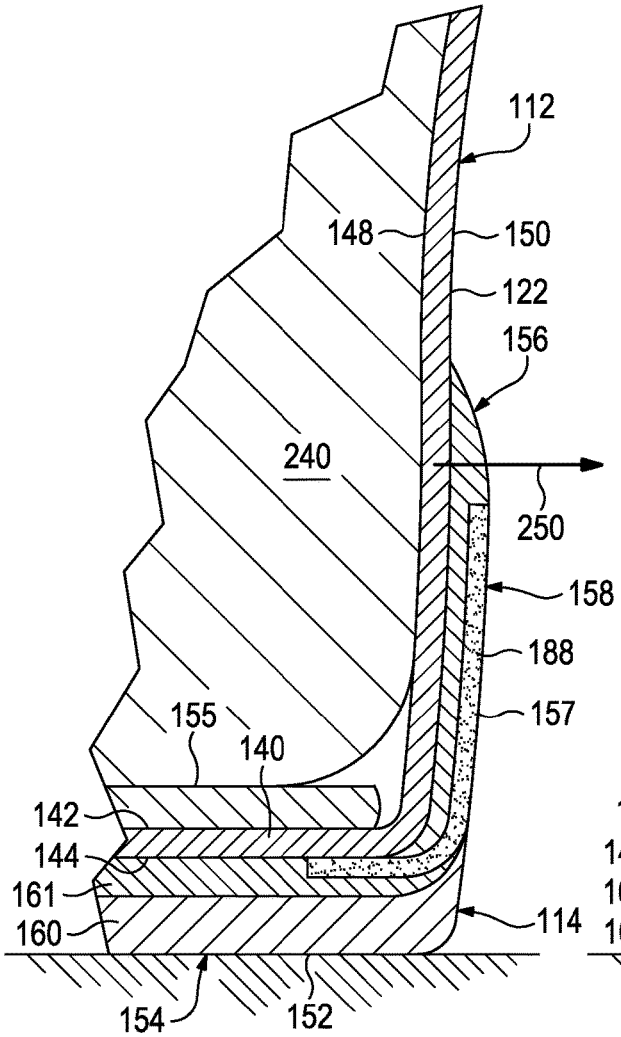
Figure 17:
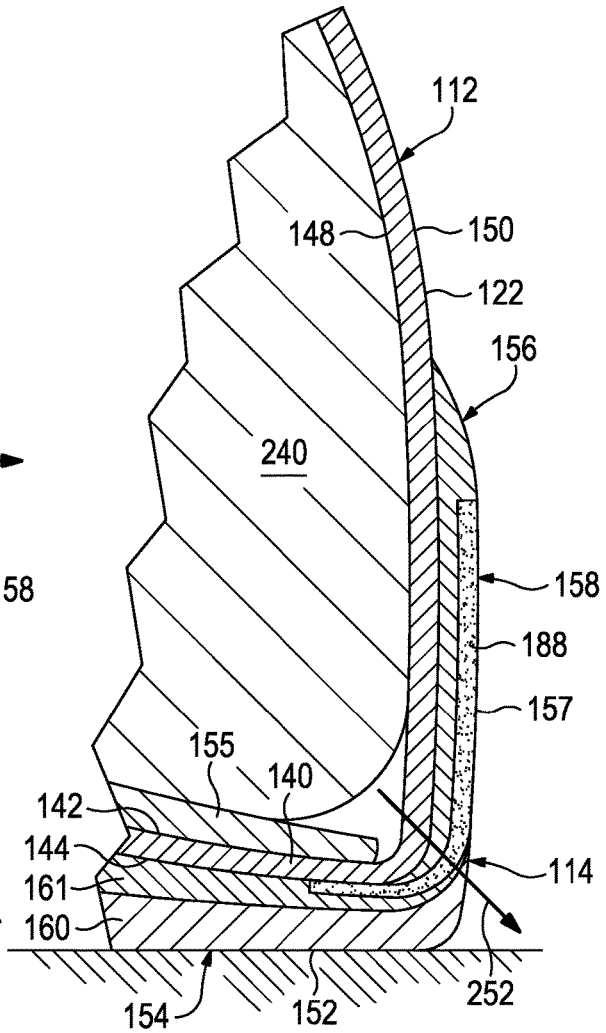

FIG. 15 a section view of a midfoot portion of the article of footwear and the wearer's foot;

FIG. 16 is a section view of the midfoot portion of the article of footwear, wherein the foot is pushing laterally against the midfoot portion; and FIG. 17 is a section view of the midfoot portion of the article of footwear, wherein the foot is pushing downward and laterally against the midfoot portion.

Corresponding reference numerals indicate corresponding parts throughout the several views of the drawings.

DETAILED DESCRIPTION

Example embodiments will now be described more fully with reference to the accompanying drawings.

Referring initially to FIGS. 1 through 4, exemplary embodiments of an article of footwear 110 are illustrated according to various teachings of the present disclosure. Generally, the article of footwear 110 can include an upper 112 and a sole structure 114 that are operably coupled together.

Footwear 110 can be configured for walking, running, or for other uses. In some embodiments, footwear 110 can be constructed for playing an athletic sport, such as basketball. Concepts of the present disclosure may also be applied to a variety of other athletic footwear types, including soccer shoes, baseball shoes, cross-training shoes, cycling shoes, football shoes, sprinting shoes, tennis shoes, and hiking boots, for example. The concepts may also be applied to footwear types that are generally considered to be non-athletic, including dress shoes, loafers, sandals, and work boots. The concepts disclosed herein apply, therefore, to a wide variety of footwear types.

As will be discussed, sole structure 114 can include one or more components that provide stiffness to sides of footwear 110. Thus, one or more areas of sole structure 114 can substantially resist bending, compression, or other flexure, for example, due to loading from the wearer's foot. As a result, sole structure 114 can support upper 112. Stiffness can be provided in predetermined areas of footwear 110, for example, to areas that are likely to be subject to high load concentrations. The sole structure 114 can also aid in distributing forces across the footwear 100 to reduce the likelihood of tearing, ripping, cracking, or other failure of footwear 110. Moreover, sole structure 114 can increase stiffness at one or more areas to support the wearer's foot during running, shifting, pivoting, jumping, or other ambulatory movements. Footwear 110 can additionally include one or more features that reduce weight of footwear 100. Furthermore, footwear 110 can be constructed according to certain teachings to increase manufacturing efficiency.

Footwear Configurations

For reference purposes, footwear 110 may be divided into three general regions: a forefoot portion 116, a midfoot portion 117, and a heel portion 118. Forefoot portion 116 can generally encompass regions of footwear 110 corresponding with forward portions of the foot, including the toes and joints connecting the metatarsals with the phalanges. Midfoot portion 117 can generally encompass regions of footwear 110 corresponding with middle portions of the foot, including an arch area of the foot. Heel portion 118 can generally encompass regions of footwear 110 corresponding with rear portions of the foot, including the heel and calcaneus bone. Midfoot portion 117 can be disposed between forefoot portion 116 and heel portion 118 relative to a longitudinal axis 124 of footwear 110. Footwear 110 can also include a medial side 120 and a lateral side 122, which each extend through each of forefoot portion 116, midfoot portion 117, and heel portion 118. Medial side 120 and lateral side 122 can be disposed on opposite sides of longitudinal axis 124. A transverse axis 126 can extend between medial side 120 and lateral side 122. Lateral side 122 can correspond with an outside area of the foot and can face away from the wearer's other foot. Medial side 120 can correspond with an inside area of the foot and can face toward the wearer's other foot. Furthermore, a vertical axis 128 can extend perpendicularly from longitudinal axis 124 and transverse axis 126. Also, medial side 120 and lateral side 122 can define a lower periphery 119 of footwear 110. More specifically, lower periphery 119 can extend about footwear 110 near a transition between upper 112 and sole structure 114. Thus, lower periphery 119 of footwear 110 can encompass the wearer's foot.

It will be appreciated that forefoot portion 116, midfoot portion 117, heel portion 118, medial side 120, and lateral side 122 are not intended to demarcate precise areas of footwear 110. Instead, forefoot portion 116, midfoot portion 117, heel portion 118, medial side 120, and lateral side 122 are intended to represent general areas of footwear 110 to aid in the following discussion. In addition to footwear 110, forefoot portion 116, midfoot portion 117, heel portion 118, medial side 120, and lateral side 122 may also be applied to upper 112, sole structure 114 and individual elements thereof. Moreover, the coordinate system defined by longitudinal axis 124, transverse axis 126, and vertical axis 128 is merely included for reference purposes and to aid in the following discussion.

Referring now to FIGS. 1 through 7, upper 112 will be discussed in greater detail according to exemplary embodiments of the present disclosure. In some embodiments, upper 112 can include one or more pieces or layers of material that is/are shaped to define an internal void 130 that can receive the wearer's foot. Also, upper 112 can be secured to the wearer's foot such that upper 112 is unlikely to inadvertently fall off the wearer's foot during ambulatory activities.

As shown in the illustrated embodiments, upper 112 can extend between forefoot portion 116, midfoot portion 117, heel portion 118, medial side 120, and lateral side 122. Upper 112 can extend substantially continuously and uninterrupted between these areas in some embodiments. In other embodiments, upper 112 can include one or more openings that expose the wearer's foot.

Additionally, portions of upper 112 can extend generally vertically and substantially parallel to vertical axis 128. These portions can define medial side 120, lateral side 122, heel portion 118, and forefoot portion 116. For purposes of discussion, these vertically extending areas of upper 112 will be referred to generally as walls 127. Walls 127 can extend toward and connect to sole structure 114. Also, opposing walls 127 can be spaced apart and can define void 130 within footwear 110.

Also, upper 112 can include a collar 132 that defines an ankle opening 134, which provides access into and out of internal void 130. Additionally, upper 112 can include a throat opening 136 that extends along longitudinal axis 124 between medial side 120 and lateral side 122. A securing device 138, such as a shoelace, can extend across throat opening 136 to selectively vary the width of the upper 112. For instance, securing device 138 can be tightened to make upper 112 more narrow for securing upper 112 to the wearer's foot. Securing device 138 can also be loosened to make upper 112 wider for releasing upper 112 from the wearer's foot. It will be appreciated that securing device 138 can be of any suitable type, such as a shoelace, a strap, a buckle, loop-and-pile tape, elastic bands, or other types of securing devices 138 without departing from the scope of the present disclosure. Also a tongue can be provided within throat opening 136 to be disposed between the securing device 138 and the wearer's foot in some embodiments.

Figure 5:
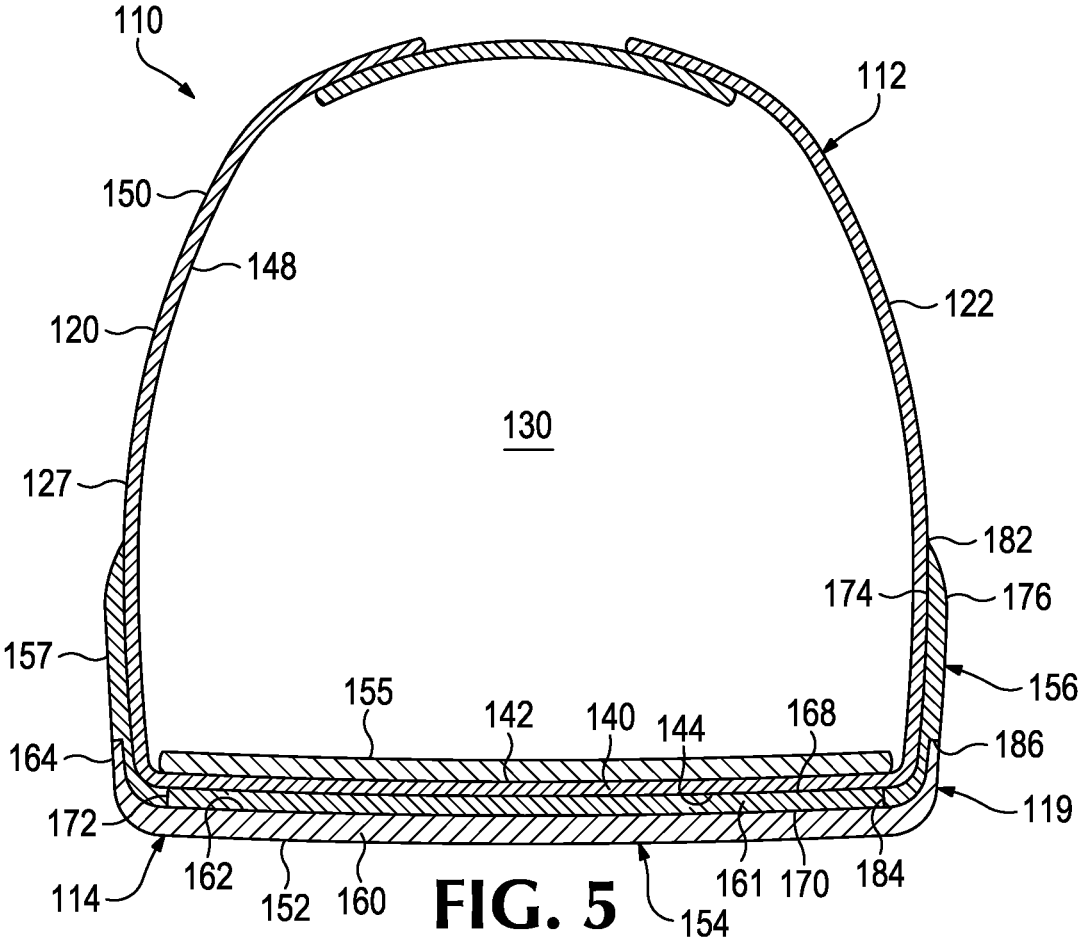
FIG. 5 is a section view of the article of footwear taken along the line 5-5 of FIG. 1.
Figure 6:
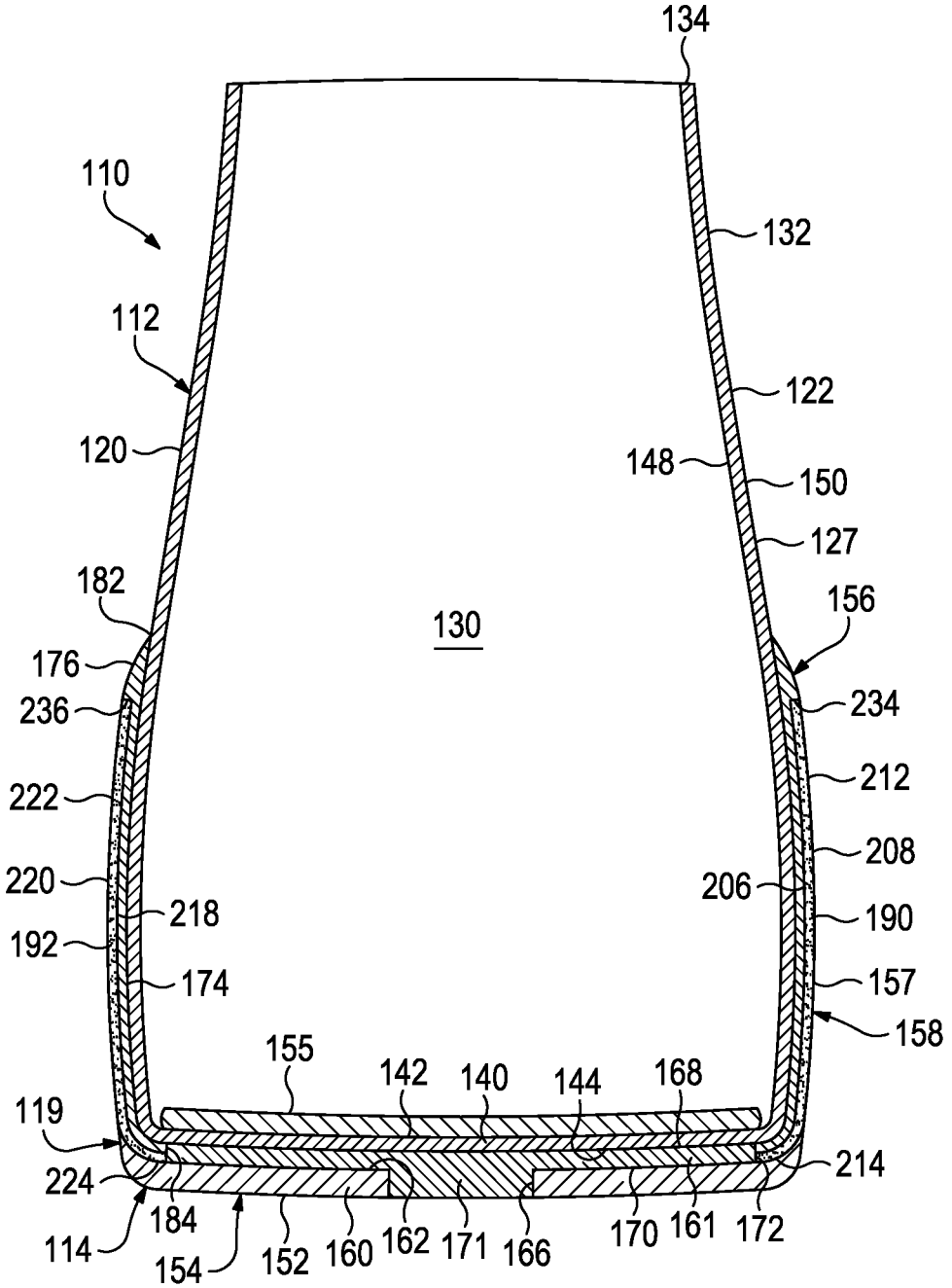
FIG. 6 is a section view of the article of footwear taken along the line 6-6 of FIG. 1.
Figure 7:
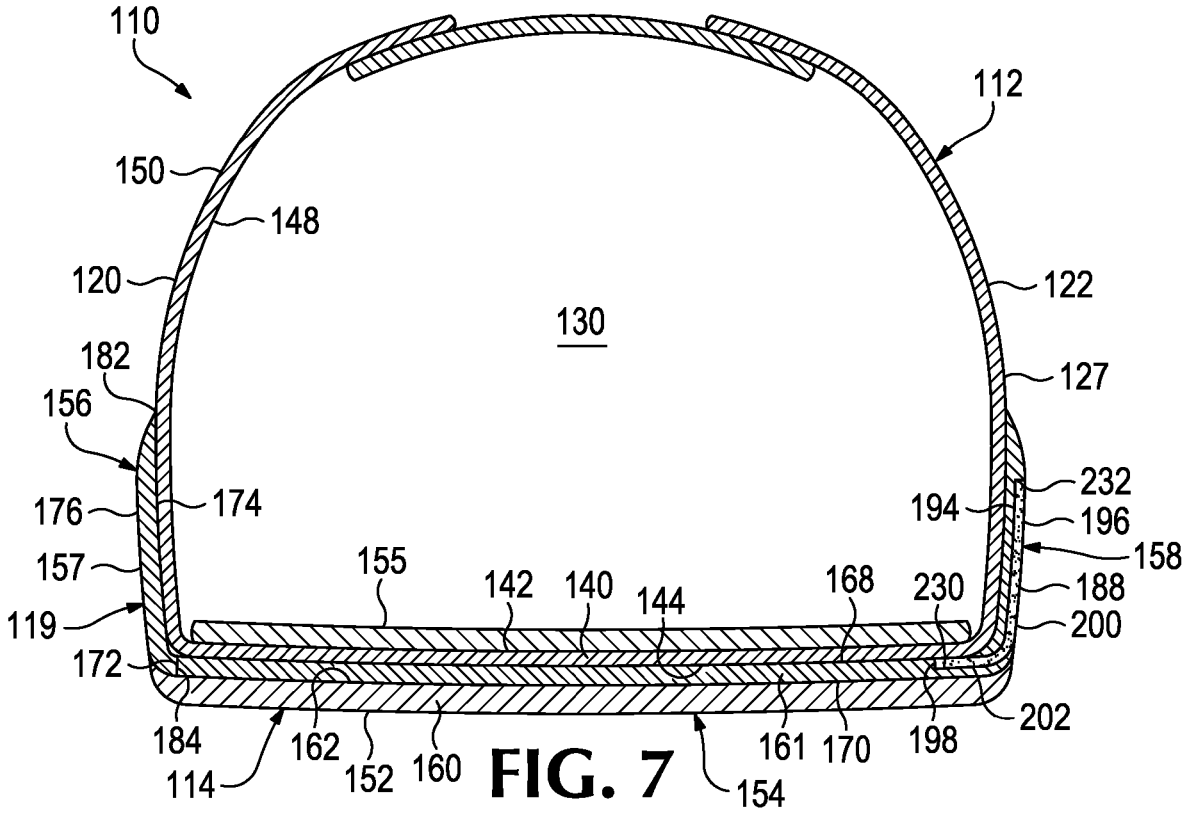
FIG. 7 is a section view of the article of footwear taken along the line 7-7 of FIG. 1.

As partially shown in FIGS. 5 through 7, upper 112 can additionally include a strobel member 140, which can also be referred to as a "strobel" or as a "strobel sock." Those having ordinary skill in the art will understand that strobel member 140 can be a sheet of material that extends horizontally between forefoot portion 116, heel portion 118, medial side 120, and lateral side 122. Stated differently, strobel member 140 can extend between opposing walls 127 of upper 112. As such, strobel member 140 can be disposed underneath the wearer's foot. For purposes of simplicity, strobel member 140 is shown in FIGS. 5 through 7 as being integrally connected to medial side 120 and lateral side 122. However, it will be appreciated that strobel member 140 can be removably attached to medial side 120 and lateral side 122, for example, by stitching.

Strobel member 140 can include an upper surface 142 and a lower surface 144. Upper surface 142 can face the sole of the wearer's foot and can abut against the wearer's foot or the stocking enclosing the wearer's foot. Lower surface 144 can face in an opposite direction from upper surface 142.

Upper 112 can be made from any suitable material. For example, upper can be formed from any one or more materials including, but not limited to, leather, synthetic leather, polymeric sheets, or other material. Also, in some embodiments, upper 112 can be formed from multiple material elements that are joined together through stitching or bonding to define void 130.

In additional embodiments, upper 112 can be at least partially formed from a knitted component 146. Knitted component 146 can have any suitable shape and size. Knitted component 146 can be formed of unitary knit construction as a one-piece element. As used herein, the term "unitary knit construction" means that the respective component is formed as a one-piece element through a knitting process. That is, the knitting process substantially forms the various features and structures of unitary knit construction without the need for significant additional manufacturing steps or processes. A unitary knit construction may be used to form a knitted component having structures or elements that include one or more courses or wales of yarn or other knit material that are joined such that the structures or elements include at least one course or wale in common (i.e., sharing a common yarn) and/or include courses or wales that are substantially continuous between each of the structures or elements. With this arrangement, a one-piece element of unitary knit construction is provided. In the exemplary embodiments, any suitable knitting process may be used to produce knitted component 146 formed of unitary knit construction, including, but not limited to a flat knitting process, such as warp knitting or weft knitting, as well as a circular knitting process, or any other knitting process suitable for providing a knitted component. Examples of various configurations of knitted components and methods for forming knitted component 146 with unitary knit construction are disclosed in U.S. Pat. No. 6,931,762 to Dua; U.S. Pat. No. 7,347,011 to Dua, et al.; U.S. Patent Application Publication 2008/0110048 to Dua, et al.; U.S. Parent Application Publication 2010/0154256 to Dua; and U.S. Patent Application Publication 2012/0233882 to Huffa, et al., each of which is entirely incorporated herein by reference.

Knitted component 146 can be formed from at least one yarn that is manipulated (e.g., with a knitting machine) to form a variety of courses and wales. Thus, adjacent areas of knitted component 146 can share at least one common course or at least one common wale. That is, knitted component 146 can have the structure of a knit textile. It will be appreciated that knitted component 146 can be formed via weft knitting operations, warp knitting operations, flat knitting operations, circular knitting operations, or other suitable methods.

Knitted component 146 may incorporate various types and combinations of stitches and yarns. With regard to stitches, the yarn forming knitted component 146 may have one type of stitch in one area and another type of stitch in another area. Depending upon the types and combinations of stitches utilized, areas of knitted component 146 may have a plain knit structure, a mesh knit structure, or a rib knit structure, for example. The different types of stitches may affect the physical properties of knitted component 146, including aesthetics, stretch, thickness, air permeability, and abrasion-resistance of knitted component 146. That is, the different types of stitches may impart different properties to different areas of knitted component 146. With regard to yarns, knitted component 146 may have one type of yarn in one area and another type of yarn in another area. Depending upon various design criteria, knitted component 146 may incorporate yarns with different deniers, materials (e.g., cotton, elastane, polyester, rayon, wool, and nylon), and degrees of twist, for example. The different types of yarns may affect the physical properties of knitted component 146, including aesthetics, stretch, thickness, air permeability, and abrasion-resistance of knitted component 146. That is, the different types of yarns may impart different properties to different areas of knitted component 146. By combining various types and combinations of stitches and yarns, each area of knitted component 146 may have specific properties that enhance the comfort, durability, and performance of footwear 110. In some configurations, multiple yarns with different colors may be utilized to form knitted component 146. When yarns with different colors are twisted together and then knitted, knitted component 146 may have a heathered appearance with multiple colors randomly distributed throughout.

Also, one or more of the yarns within knitted component 146 may be partially formed from a thermoplastic polymer material, which softens or melts when heated and returns to a solid state when cooled. More particularly, the thermoplastic polymer material transitions from a solid state to a softened or liquid state when subjected to sufficient heat, and then the thermoplastic polymer material transitions from the softened or liquid state to the solid state when sufficiently cooled. As such, the thermoplastic polymer materials within the yarns can be used to join two objects or elements together as will be discussed in greater detail below. Knitted component 146 can incorporate these so-called "fusible" yarns according to co-owned U.S. Pat. No. 6,910,288, which issued on Jun. 28, 2005, and which is incorporated by reference in its entirety.

Knitted component 146 can be configured to at least partially extend through forefoot portion 116, midfoot portion 117, and/or heel portion 118. Knitted component 146 can also extend along both lateral side 122 and medial side 120 in some embodiments. In addition, knitted component 146 can at least partially define an internal surface 148 and/or an external surface 150 of upper 112.

It will be appreciated that upper 112 can be lightweight and flexible. Accordingly, upper 112 can readily conform to the shape of the wearer's foot. Also, upper 112 can flex substantially in concert with the wearer's foot. Thus, the upper 112 can provide comfort and support to the wearer's foot.

Given the lightweight and flexible nature of upper 112, sole structure 114 can include features that provide necessary strength and stiffness to footwear 110. Thus, footwear 110 can be durable and can provide necessary support when subjected to relatively high loading.

For example, in some embodiments that will be discussed, sole structure 114 can include one or more stiffeners that provide such strength and stiffness along the lower periphery 119 of footwear 110. Sole structure 114 can also include components that support the stiffener(s). The supporting components can facilitate assembly of footwear 110. The supporting components can also ensure that the stiffeners are securely attached to upper 112. Furthermore, the supporting components can allow forces to transfer and distribute effectively through footwear 110. Moreover, the supporting components and stiffener(s) can be shaped, constructed, and arranged to provide weight savings for footwear 110. In addition, components of sole structure 114 can be interconnected in a way that allows sole structure 114 to appear sleek, aerodynamic, and otherwise provide pleasing aesthetics.

Embodiments of Sole Structure

Referring now to FIGS. 1 through 7, sole structure 114 will be discussed in detail according to exemplary embodiments. Generally, sole structure 114 can be attached to upper 112 and can extend under the wearer's foot. Also, sole structure 114 can define a ground engaging surface 152 that engages the ground, floor, running track, or other supporting surface. Ground engaging surface 152 can provide increased traction when walking, running, or jumping. Sole structure 114 can additionally define a side exterior surface 157 that extends upward from ground engaging surface 152. Furthermore, one or more portions of sole structure 114 can be resiliently deformable to attenuate impact forces while walking, running, or jumping. Additionally, the sole structure 114 can resiliently recover from such impact to provide energy return to the wearer's foot.

Figure 4:
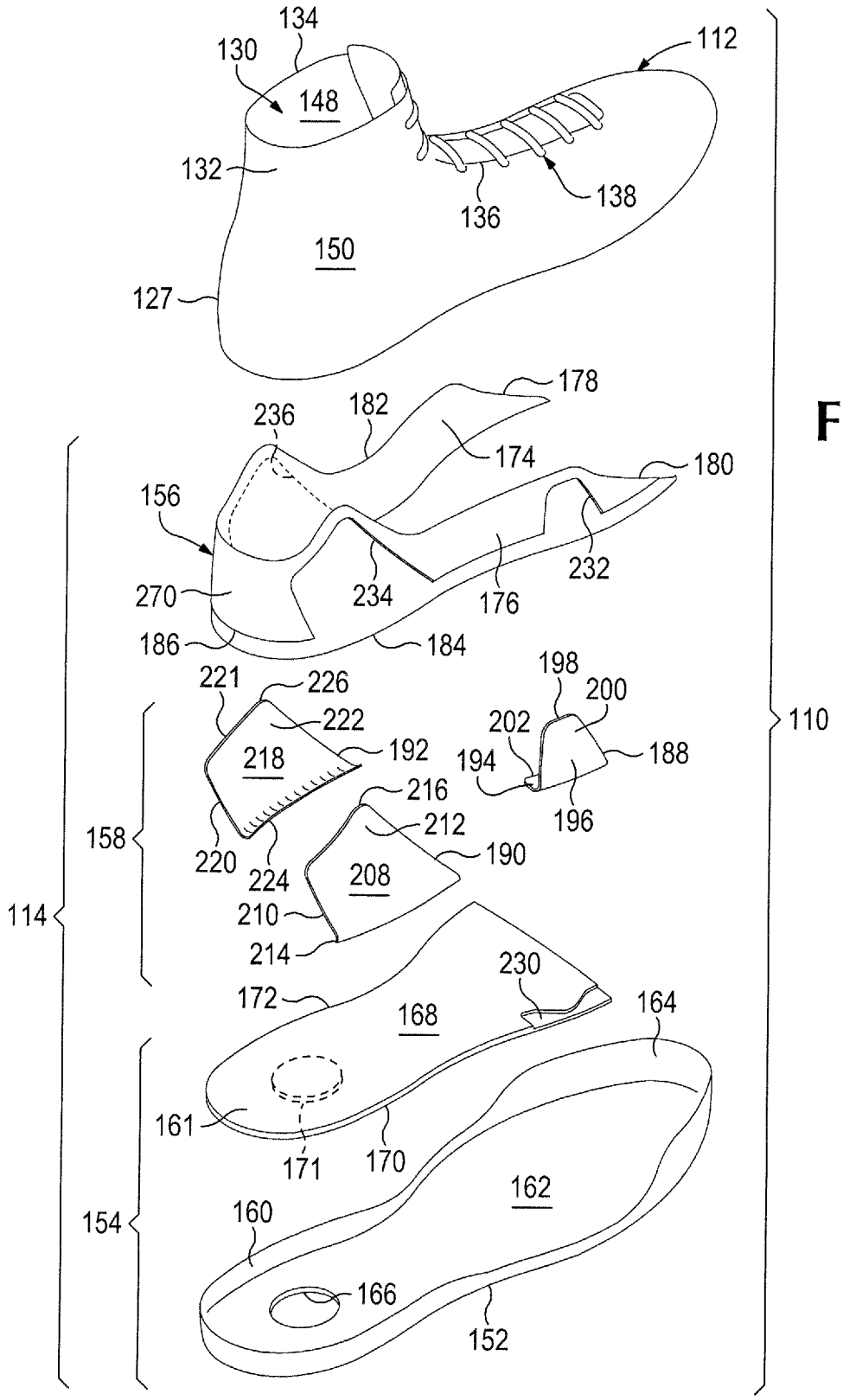
FIG. 4 is an exploded perspective view of the article of footwear of FIG. 1.

As shown in FIG. 4, sole structure 114 can generally include a base member 154, an intermediate member 156, and one or more stiffeners 158. Base member 154 can extend substantially horizontally, along longitudinal axis 124 and transverse axis 126. Thus, base member 154 can extend underneath the wearer's foot and provide traction and cushioning. Intermediate member 156 can extend substantially vertically along vertical axis 128 and can be attached to upper 112. For example, in some embodiments, intermediate member 156 can be attached to external surface 150 of upper 112. In other embodiments, intermediate member 156 can be attached to internal surface 148 of upper 112. Additionally, stiffener(s) 158 can be coupled to upper 112 to provide stiffness. For example, stiffener(s) 158 can attach to upper 112 via intermediate member 156 in some embodiments. Also, in some embodiments, stiffener(s) 158 can attach to both intermediate member 156 and base member 154. Stiffener(s) 158 can provide increased stiffness to predetermined areas of footwear 110, to support upper 112, to reinforce upper 112, to distribute forces across footwear 110, and/or to substantially maintain the wearer's foot over base member 154.

Base member 154 will now be discussed in greater detail according to exemplary embodiments. Base member 154 can extend horizontally between medial side 120 and lateral side 122 of upper 112. Base member 154 can also extend horizontally between forefoot portion 116 and heel portion 118 of upper 112. Stated differently, base member 154 can extend between opposing vertical walls 127 of upper 112. Also, strobel member 140 can be disposed over or otherwise adjacent to base member 154 in some embodiments. Accordingly, base member 154 can be disposed substantially underneath the wearer's foot.

In some embodiments, base member 154 can define ground engaging surface 152. Also, base member 154 can provide traction for article of footwear 110. Moreover, in some embodiments, base member 154 can be resilient and compressible. Accordingly, base member 154 can attenuate impact forces, provide energy return to the wearer's foot, and otherwise cushion the wearer's foot.

Additionally, base member 154 can be a single-body element. In other embodiments, such as the embodiment of FIG. 4, base member 154 can include separate components. For example, base member 154 can include an outsole 160 and a base pad 161. In some embodiments shown in FIGS. 5 through 7, base member 154 can also include an insole 155 and/or other components that extend underneath the wearer's foot.

Outsole 160 can include an upper surface 162 that faces upper 112. Upper surface 162 can be relatively flat. Outsole 160 can also define ground engaging surface 152, which faces away from upper 112. Ground engaging surface 152 can include grooves, openings, or other features that can increase traction. Outsole 160 can further include an upturned lip 164. Lip 164 can be disposed at a peripheral edge of outsole 160 and can project upward from upper surface 162. In some embodiments, lip 164 can extend continuously about the periphery of outsole 160. Additionally, in some embodiments, outsole 160 can include an opening 166. Opening 166 can be a through-hole that extends through both upper surface 162 and ground engaging surface 152. Opening 166 can be disposed in any suitable location on outsole 160. For example, as shown in FIG. 4, opening 166 can be disposed generally in heel portion 118 of outsole 160.

Outsole 160 can be made out of any suitable material. For example, in some embodiments, outsole 160 can be made out of a material with a relatively high coefficient of friction, such as rubber.

Base pad 161 can include an upper surface 168 that faces upper 112. Base pad 161 can also include a lower surface 170 that faces away from upper 112. Furthermore, base pad 161 can include a peripheral edge 172 that extends between upper surface 168 and lower surface 170. In some embodiments, upper surface 168 can be substantially flat. In other embodiments, upper surface 168 can be slightly concave such that upper surface 168 substantially corresponds to the curvature of the wearer's foot.

Furthermore, base pad 161 can have any suitable shape and size. For example, in some embodiments, base pad 161 can be disposed generally in heel portion 118 of sole structure 114. Base pad 161 can also extend forward along longitudinal axis 124 into midfoot portion 117. Base pad 161 can terminate at midfoot portion 117, leaving forefoot portion 116 of upper surface 162 of outsole 160 exposed. Additionally, base pad 161 can extend between medial side 120 and lateral side 122. In some embodiments, lip 164 of outsole 160 can encompass base pad 161.

Lower surface 170 can abut and can be attached to upper surface 162 of outsole 160. In some embodiments, lower surface 170 can be attached to upper surface 162 in any suitable fashion. For example, lower surface 170 can be attached using adhesives, plastic welding, fasteners, or other attachment devices and methods. Moreover, in some embodiments represented in FIG. 6, lower surface 170 can include a projection 171 that is received within opening 166 of outsole 160. Thus, projection 171 can be exposed through the opening 166. Projection 171 can be sized and shaped to substantially fill opening 166. Also in some embodiments, projection 171 can be substantially flush with ground engaging surface 152 of outsole 160. Because of projection 171 base pad 161 can have increased thickness underneath the wearer's heel. Accordingly, base pad 161 can provide substantial cushioning to the wearer's heel. Also, projection 171 can be received in opening 161 of outsole 160 to provide visual and tactile confirmation that base member 154 has been assembled correctly. Therefore, projection 171 can facilitate assembly of base member 154 of footwear 110.

Base pad 161 can be made from any suitable material. For example, in some embodiments, base pad 161 can be made from a resiliently compressible material, such as polymeric foam. Also, base pad 161 can be more elastic and more resiliently compressible than outsole 160. Accordingly, base pad 161 can provide cushioning to wearer's foot. In some embodiments, base pad 161 can be referred to as a "midsole".

Additionally, in some embodiments, base member 154 can include an insole 155. Insole 155 can be a layer of resiliently compressible material, such as foam. Insole 155 can be contoured in some embodiments to mate against corresponding curved surfaces of the sole of the wearer's foot. As shown in FIGS. 5 through 7, insole 155 can be layered over strobel member 140. In some embodiments, insole 155 may be referred to as a "sockliner".

It will be appreciated that base member 154 can include additional components in some embodiments. For example, in some embodiments, base member 154 can include additional members that provide cushioning. More specifically, base member 154 can include a midsole that incorporates plates, moderators, fluid-filled chambers, lasting elements, or motion control members that further attenuate forces, enhance stability, or influence the motions of the foot. In still other cases, the midsole may be primarily formed from a fluid-filled chamber that is located within an upper and is positioned to extend under a lower surface of the foot to enhance the comfort of an article.

Intermediate member 156 of sole structure 114 will now be discussed in detail according to exemplary embodiments. Intermediate member 156 can be an elongate member that is relatively thin, such as an elongate strip. In some embodiments, intermediate member 156 may be referred to as "foxing" or "rand". Intermediate member 156 can have an inner surface 174 and an outer surface 176. Inner surface 174 can face upper 112. Outer surface 176 can face away from upper 112 and can at least partially define side external surface 157 of sole structure 114. Intermediate member 156 can additionally include a first terminal end 178, a second terminal end 180, a top edge 182, and a bottom edge 184, which cooperate to define the periphery of intermediate member 156.

Intermediate member 156 can be attached to external surface 150 of upper 112 in some embodiments. For example, inner surface 174 of intermediate member 156 can abut and can be attached to external surface 150 of upper 112, along lower periphery 119 of footwear 110. Inner surface 174 of intermediate member 156 can be attached in any suitable fashion. For example, inner surface 174 of intermediate member 156 can be attached using adhesives, such as bonding cement. In additional embodiments inner surface 174 can be attached using plastic welding techniques. In still other embodiments, intermediate member 156 can be attached using fasteners or other devices. Intermediate member 156 can be configured to attach securely to external surface 150 even in embodiments in which upper 112 includes a knitted component 146. For example, intermediate member 156 can be made of a material that is flexible enough to remain attached to external surface 150 as knitted component 146 flexes.

When attached to upper 112, intermediate member 156 can extend continuously along lower periphery 119 from medial side 120, across heel portion 118, to lateral side 122 of footwear 110. As such, first terminal end 178 can be disposed at midfoot portion 117 on medial side 120, and second terminal end 180 can be disposed at midfoot portion 117 on lateral side 122.

Intermediate member 156 can also be attached to outsole 160 in some embodiments. For example, in some embodiments, lip 164 of outsole 160 can be attached to outer surface 176 of intermediate member 156 adjacent to bottom edge 184. Thus, lip 164 can also partially define side external surface 157 of sole structure 114.

Intermediate member 156 can be attached to outsole 160 in any suitable fashion. For example, intermediate member 156 can be attached using adhesives, such as bonding cement. In additional embodiments, intermediate member 156 can be attached to outsole 160 using plastic welding techniques. In still other embodiments, intermediate member 156 can be attached using fasteners or other devices.

In some embodiments shown in FIG. 4, intermediate member 156 can include a lower recess 186. Lower recess 186 can be defined on outer surface 176 and can extend along bottom edge 184 of intermediate member 156. Lip 164 of outsole 160 can be received within lower recess 186. In some embodiments, lower recess 186 can allow lip 164 to be substantially flush with areas of outer surface 176 that are immediately adjacent recess 186. With this configuration, sole structure 114 can have a relatively smooth surface at the transition between lip 164 of outsole 160 and outer surface 176 of intermediate member 156. In some cases, the smooth surface transition between lip 164 and intermediate member 156 can improve aerodynamics of sole structure 114. Also, the flush transition between lip 164 and outer surface 176 can be sleek looking and/or provide other aesthetic advantages. Recess 186 can also provide a visual indication of where to place lip 164 to facilitate assembly of footwear 110. Moreover, recess 186 can reduce weight of footwear 110.

Intermediate member 156 can be made out of any suitable material. For example, intermediate member 156 can be made from rubber or other polymeric material, composite material, foam, leather, or another material. In some embodiments, intermediate member 156 can be made from the same material as outsole 160. Also, in some embodiments, intermediate member 156 can be made from or include a material that makes intermediate member 156 stiffer than upper 112. For example, in some embodiments, upper 112 can include knitted component 146 and can be highly flexible, whereas intermediate member 156 can be made from rubber or other polymer and can be less flexible. Accordingly, intermediate member 156 can provide added stiffness to footwear 110. Also, intermediate member 156 can reinforce footwear 110. Moreover, intermediate member 156 can attenuate and absorb forces that are translated through upper 112. Furthermore, as will be discussed, intermediate member 156 can secure stiffeners 158 to upper 112.

As stated, footwear 110 can include one or more stiffeners 158. Stiffeners 158 can be included at predetermined areas of footwear 110. For example, stiffeners 158 can be included generally at areas of transition between upper 112 and sole structure 114. Also, stiffeners 158 can be included at the lower periphery 119 of footwear 110, such as medial side 120 and/or lateral side 122, of footwear 110. Moreover, one stiffener 158 can be attached to medial side 120 at lower periphery 119 while another stiffener 158 can be attached to lateral side 122 at lower periphery 119. Stiffeners 158 can provide stiffness to these areas of footwear 110 without significantly increasing weight of footwear 110. Stiffeners 158 can also be attached to both intermediate member 156 and base member 154. Stiffeners 158 can also attach to portions of upper 112 via intermediate member 156. As such, stiffeners 158 can be securely attached to footwear 110 as will be discussed in greater detail below. Moreover, stiffeners 158 can effectively support the wearer's foot, for example, by maintaining the wearer's foot substantially over base member 154.

As shown in FIG. 4, some embodiments of footwear 110 can include a first stiffener 188, a second stiffener 190, and a third stiffener 192, which are spaced apart from each other. However, it will be appreciated that footwear 110 can include any number of stiffeners 158, and stiffeners 158 can vary from those shown and described herein without departing from the scope of the present disclosure.

Figure 10:
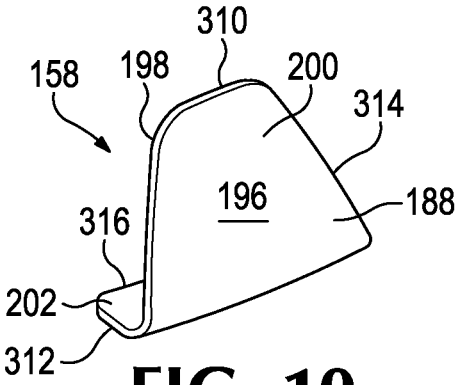
FIG. 10 is an outer perspective view of a midfoot lateral stiffener of the article of footwear of FIG. 1.
Figure 11:
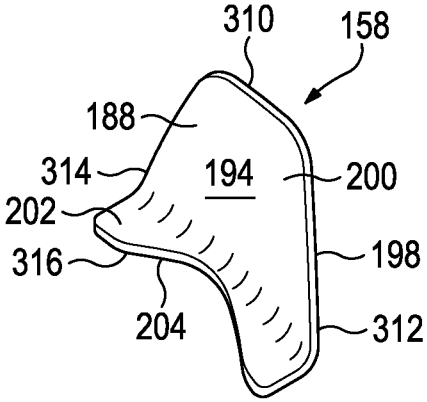
FIG. 11 is an inner perspective view of the midfoot lateral stiffener of the article of footwear of FIG. 1.

As shown in FIGS. 4, 10, and 11, first stiffener 188 can be relatively thin. Stiffener 188 can include an inner surface 194, an outer surface 196, and a peripheral edge 198. Peripheral edge 198 can comprise a top edge 310, a first side edge 312, a second side edge 314, and a bottom edge 316 in some embodiments. Transitions between top edge 310, first side edge 312, second side edge 314, and bottom edge 316 can be rounded in some embodiments.

In some embodiments, first stiffener 188 can have a substantially constant thickness measured between inner surface 194 and outer surface 196. In other embodiments, thickness of first stiffener 188 can vary across first stiffener 188. Inner surface 194 and/or outer surface 196 can be substantially smooth in some embodiments. In other embodiments, inner surface 194 and/or outer surface 196 can include a rib or other projection that provides added stiffness.

First stiffener 188 can also have a generally L-shaped cross section as shown in FIG. 7. For example, first stiffener 188 can include a first portion 200 that extends generally vertically along vertical axis 128. First stiffener 188 can also include a second portion 202 that extends transversely from first portion 200 generally along transverse axis 126. Accordingly, as shown in the embodiments of FIGS. 10 and 11, first side edge 312 and second side edge 314 can extend between first portion 200 and second portion 202. As depicted in FIGS. 4 and 7, first portion 200 extends from a junction with second portion 202 to a first terminal end, second portion 202 extends from the junction with first portion 200 and terminates at a second terminal end, the first terminal end a separated from the junction by a greater distance than the second terminal end a separated from the junction, and the second terminal end a located between lateral side 122 and medial side 120 of sole structure 114. Also as depicted in FIGS. 4 and 7, the second terminal end terminates before a midline extend between a forefoot and a heel of the article of footwear.

In some embodiments represented in FIGS. 10 and 11, first side edge 312 and second side edge 314 can be angled relative to each other such that first portion 200 of first stiffener 188 tapers. For example, top edge 310 can be shorter in length than bottom edge 316 due to this tapering in some embodiments.

Additionally, in some embodiments, bottom edge 316 can include an opening 204 as shown in FIG. 11. Opening 204 can be a contoured void, a notch, a groove, a through-hole, or other type of aperture. It will be appreciated that opening 204 can provide weight savings or other benefits for article of footwear 110.

First stiffener 188 can also include one or more curved surfaces that increase stiffness of first stiffener 188. For example, first stiffener 188 can be curved at the transition between first portion 200 and second portion 202. Stated differently, first stiffener 188 can be curved around an axis that is substantially parallel to longitudinal axis 124. Also, in some embodiments, first stiffener 188 can curve around an axis that is substantially parallel to vertical axis 128. Thus, first stiffener 188 can be three-dimensionally curved. Stated differently, inner surface 194 can be concavely and three-dimensionally curved.

Figure 9:
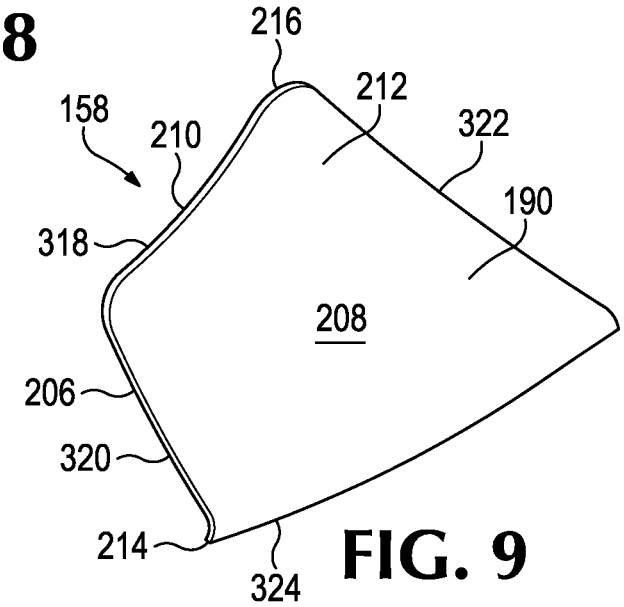
FIG. 9 is a perspective view of a lateral heel stiffener of the article of footwear of FIG. 1.

As shown in FIGS. 4 and 9, second stiffener 190 can also be relatively thin. Stiffener 190 can include an inner surface 206, an outer surface 208, and a peripheral edge 210. Peripheral edge 210 can comprise a top edge 318, a first side edge 320, a second side edge 322, and a bottom edge 324. Transitions between top edge 318, first side edge 320, second side edge 322, and bottom edge 324 can be rounded in some embodiments. In some embodiments, second stiffener 190 can have a substantially constant thickness measured between inner surface 206 and outer surface 208. In other embodiments, thickness of second stiffener 190 can vary across second stiffener 190. Inner surface 206 and/or outer surface 208 can be substantially smooth in some embodiments. In other embodiments, inner surface 206 and/or outer surface 208 can include a rib or other projection that provides added stiffness.

Second stiffener 190 can also have a generally L-shaped cross section as shown in FIG. 6. For example, second stiffener 190 can include a first portion 212 that extends vertically along vertical axis 128. Second stiffener 190 can also include a second portion 214 that extends transversely from first portion 212 along transverse axis 126. As shown in FIG. 6, second portion 214 can be relatively short compared to first portion 212.

Figure 1:
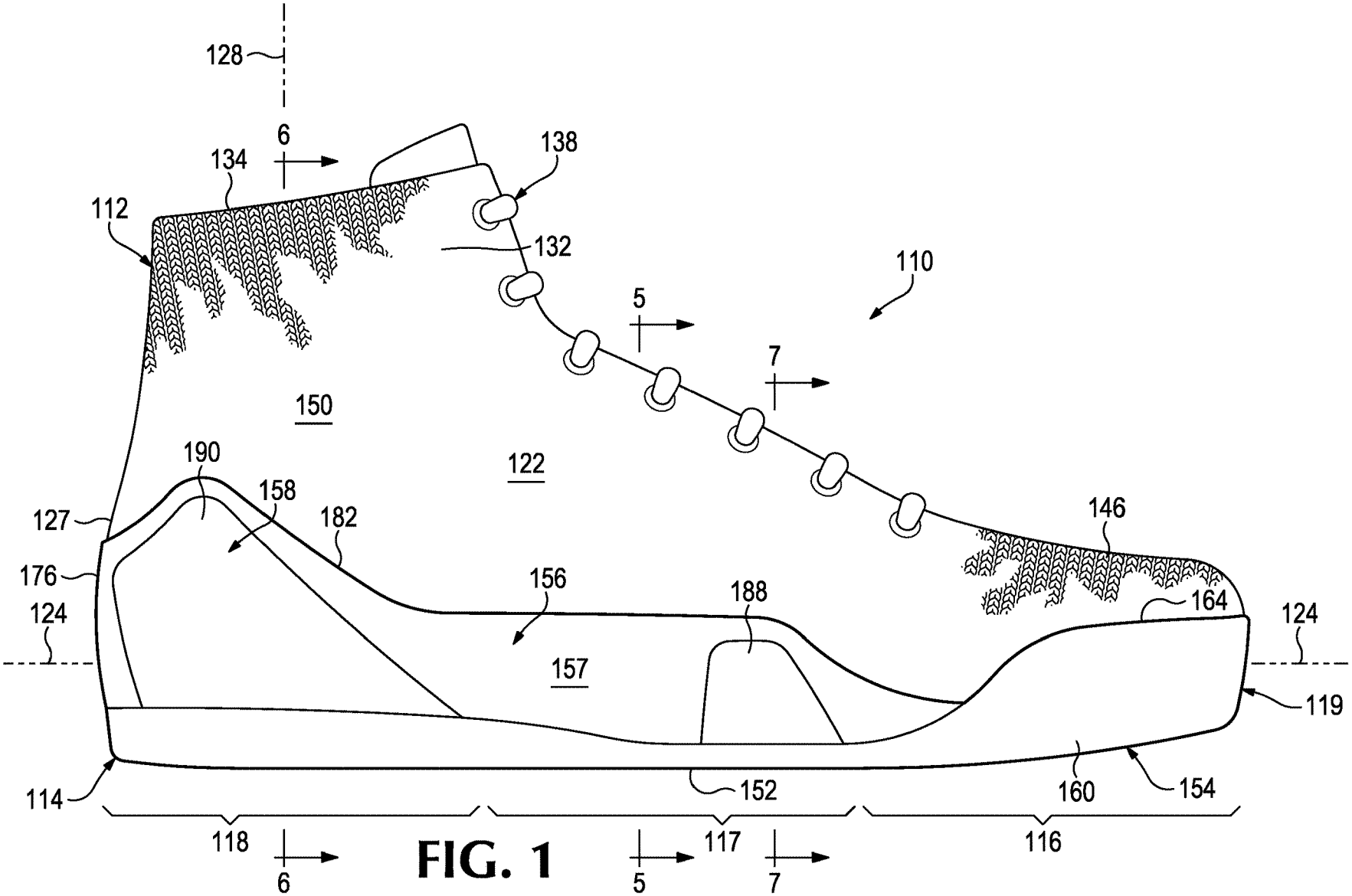
FIG. 1 is a lateral view of an article of footwear according to exemplary embodiments of the present disclosure.

Also, first portion 212 can be tapered in some embodiments. For example, as shown in FIGS. 1, 4, and 9, as first portion 212 extends away from second portion 214, first portion 212 can taper and terminate at a rounded apex 216. Apex 216 can be defined at a transition between top edge 318 and second side edge 322.

Second stiffener 190 can also include one or more curved surfaces that increase stiffness of second stiffener 190. For example, second stiffener 190 can be curved at the transition between first portion 212 and second portion 214. Stated differently, second stiffener 190 can be curved around an axis that is substantially parallel to longitudinal axis 124. Also, in some embodiments, second stiffener 190 can curve around an axis that is substantially parallel to vertical axis 128. Thus, second stiffener 190 can be three-dimensionally curved. Stated differently, inner surface 206 can be concavely and three-dimensionally curved.

Third stiffener 192 can be substantially similar to second stiffener 190; however, third stiffener 192 can be a substantially mirror image to second stiffener 190. In some embodiments, second stiffener 190 and third stiffener 192 can be substantially symmetric about longitudinal axis 124.

Figure 8:
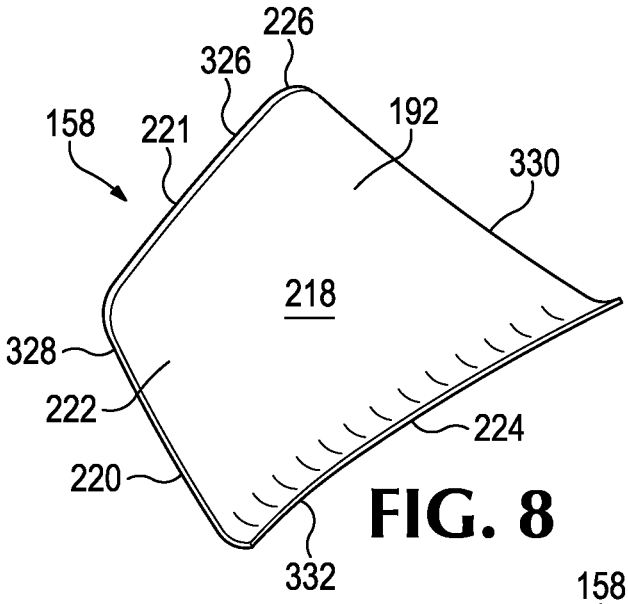
FIG. 8 is a perspective view of a medial heel stiffener of the article of footwear of FIG. 1.

As shown in FIGS. 4 and 8, third stiffener 192 can be relatively thin. Third stiffener 192 can include an inner surface 218, an outer surface 220, and a peripheral edge 221. Peripheral edge 221 can comprise a top edge 326, a first side edge 328, a second side edge 330, and a bottom edge 332. Transitions between top edge 326, first side edge 328, second side edge 330, and bottom edge 332 can be rounded in some embodiments. In some embodiments, third stiffener 192 can have a substantially constant thickness measured between inner surface 218 and outer surface 220. In other embodiments, thickness of third stiffener 192 can vary across third stiffener 192. Inner surface 218 and/or outer surface 220 can be substantially smooth in some embodiments. In other embodiments, inner surface 218 and/or outer surface 220 can include a rib or other projection that provides added stiffness.

Third stiffener 192 can also have a generally L-shaped cross section as shown in FIG. 6. For example, third stiffener 192 can include a first portion 222 that extends vertically along vertical axis 128. Third stiffener 192 can also include a second portion 224 that extends transversely from first portion 222 along transverse axis 126. As shown in FIG. 6, second portion 224 can be relatively short compared to first portion 222.

Figure 2:
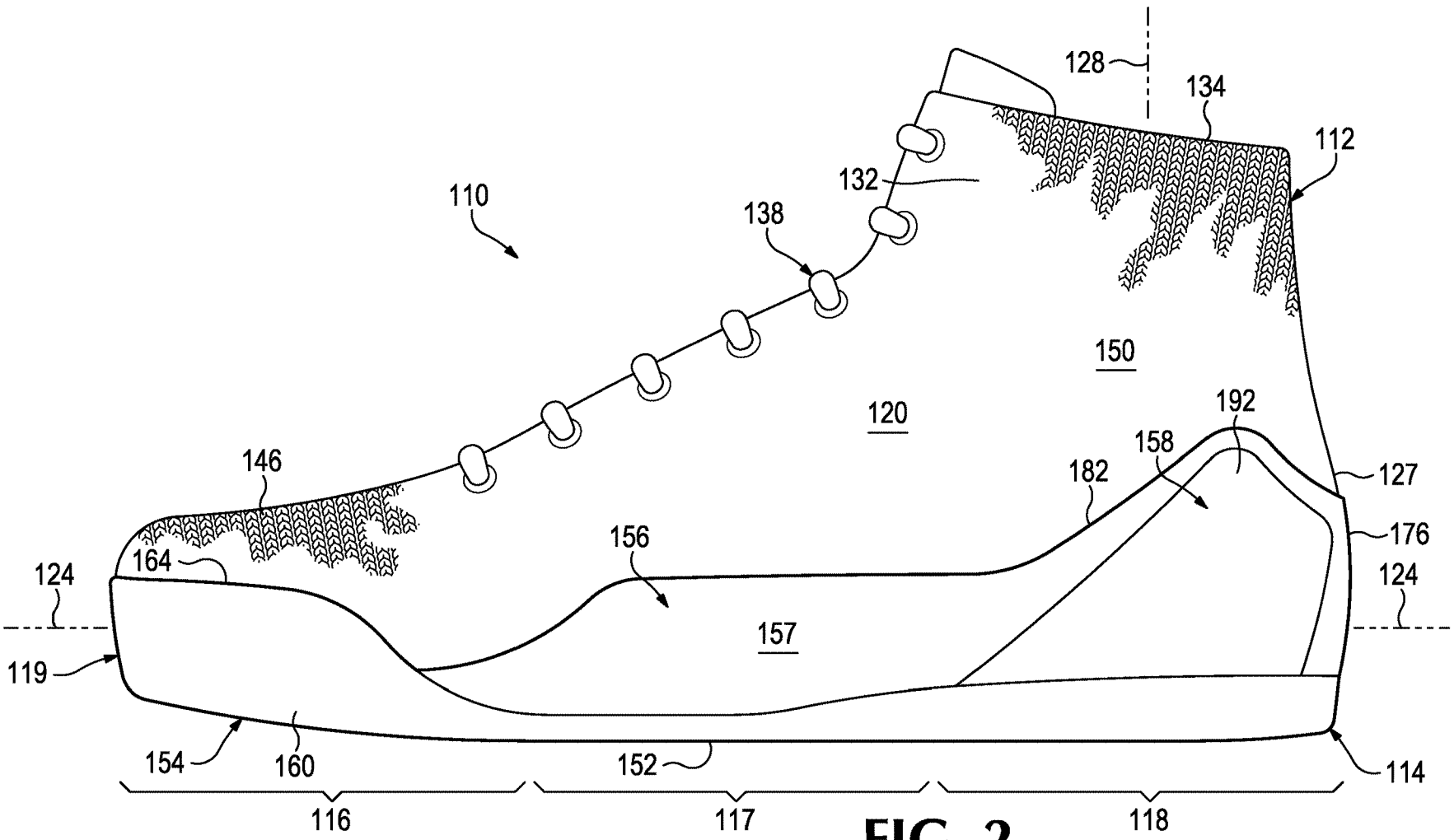
FIG. 2 is a medial view of the article of footwear of FIG. 1.

Also, first portion 222 can be tapered in some embodiments. For example, as shown in FIGS. 2 and 8, as first portion 222 extends away from second portion 224, first portion 222 can taper and terminate at a rounded apex 226. Apex 226 can be defined at a transition between top edge 326 and second side edge 330.

Third stiffener 192 can also include one or more curved surfaces that increase stiffness of third stiffener 192. For example, third stiffener 192 can be curved at the transition between first portion 222 and second portion 224. Stated differently, third stiffener 192 can be curved around an axis that is substantially parallel to longitudinal axis 124. Also, in some embodiments, third stiffener 192 can curve around an axis that is substantially parallel to vertical axis 128. Thus, third stiffener 192 can be three-dimensionally curved. Stated differently, inner surface 218 can be concavely and three-dimensionally curved.

Stiffeners 158 can be made out of any suitable material. In some embodiments, first stiffener 188, second stiffener 190, and/or third stiffener 192 can be made out of a lightweight material with high strength and high elastic modulus. Accordingly, stiffeners 158 can be more stiff than intermediate member 156 and upper 112.

For example, in some embodiments, first stiffener 188, second stiffener 190, and/or third stiffener 192 can be made from a composite material, such as carbon composite material, fiberglass material, other fiber-reinforced plastic, or other materials that include a matrix and a reinforcing material that is embedded within the matrix. In some embodiments, the fibers or other reinforcing material can be oriented along predetermined load paths such that the stiffener 158 can withstand typical loads without fracture. In additional embodiments, first stiffener 188, second stiffener 190, and/or third stiffener 192 can be made from and/or include a metallic material.

Stiffeners 158 can be attached within sole structure 114 in any suitable fashion. Adhesives, such as bonding cement, can be used in some embodiments. In other embodiments, first stiffener 188, second stiffener 190, and/or third stiffener 192 can be attached using fasteners, can be embedded within sole structure 114, or can be attached in other suitable ways.

Additionally, stiffeners 158 can be disposed in any suitable location of sole structure 114. Stiffeners 158 can be disposed in locations that are subjected to particularly high loading and/or in locations where increased stiffness can provide effective support for the wearer's foot. In some embodiments, for example, stiffeners 158 can be disposed generally at lower periphery 119 of footwear 110. For example, as shown in FIGS. 1, 4, and 7, first stiffener 188 can be located in midfoot portion 117 at lower periphery 119 of lateral side 122 of footwear 110. Also, as shown in FIGS. 1, 3, 4 and 6, second stiffener 190 can be located in heel portion 118 on at lower periphery 119 of lateral side 122 of footwear 110. Furthermore, as shown in FIGS. 2, 3, 4, and 6, third stiffener 192 can be located in heel portion 118 on at lower periphery 119 of medial side 120 of footwear 110.

As shown in FIG. 7, inner surface 194 of first portion 200 of first stiffener 188 can abut and can be attached to outer surface 176 of intermediate member 156. Also, inner surface 194 of second portion 202 can abut and can be attached to strobel member 140 in some embodiments. Outer surface 196 of second portion 202 of first stiffener 188 can abut and can be attached to upper surface 168 of base pad 161. Outer surface 196 of first portion 200 of first stiffener 188 can be exposed. As such, outer surface 196 can partially define side exterior surface 157 of sole structure 114.

Moreover, as shown in FIG. 6, inner surface 206 of second stiffener 190 can abut and can be attached to outer surface 176 of intermediate member 156. Also, outer surface 208 of second portion 214 of second stiffener 190 can abut and can be attached to upper surface 162 of outsole 160. Furthermore, outer surface 208 of first portion 212 of second stiffener 190 can be exposed and can partially define side exterior surface 157 of sole structure 114.

Likewise, as shown in FIG. 6, inner surface 218 of third stiffener 192 can abut and can be attached to outer surface 176 of intermediate member 156. Also, outer surface 220 of second portion 224 of third stiffener 192 can abut and can be attached to upper surface 162 of outsole 160. Furthermore, outer surface 220 of first portion 222 of third stiffener 192 can be exposed. As such, outer surface 220 can partially define side exterior surface 157 of sole structure 114.

Furthermore, in some embodiments, sole structure 114 can include one or more recesses, openings, apertures, or other features that receive portions of stiffeners 158. These features can allow surfaces of stiffeners 158 to be positioned substantially flush with surrounding surfaces of sole structure 114. Accordingly, edges of stiffeners 158 are unlikely to catch against another object and detach from sole structure 114. Additionally, the flush transition between stiffeners 158 and surrounding surfaces can cause sole structure 114 to be more aesthetically pleasing. Also, sole structure 114 can be more aerodynamic because of these features. Moreover, these features can decrease weight of sole structure 114 and can facilitate assembly of footwear 110.

For example, as shown in FIGS. 4 and 7, upper surface 168 of base pad 161 can include a base recess 230 that receives second portion 202 of first stiffener 188. In some embodiments, base recess 230 and second portion 202 can have a corresponding shape and second portion 202 can substantially fill base recess 230. Also, as shown in FIG. 7, the depth of base recess 230 and the thickness of second portion 202 can be substantially equal such that inner surface 194 is substantially flush with surrounding areas of upper surface 168 of base pad 161. Accordingly, the wearer is unlikely to feel any uncomfortable ridges or raised areas at the transition between second portion 202 and base pad 161.

Furthermore, as shown in FIGS. 4 and 7, outer surface 176 of intermediate member 156 can include a first recess 232 that receives first portion 200 of first stiffener 188. In some embodiments, first recess 232 and first portion 200 can have a corresponding shape and first portion 200 can substantially fill first recess 232. Also, as shown in FIG. 7, the depth of first recess 232 and the thickness of first portion 200 can be substantially equal such that outer surface 196 is substantially flush with surrounding areas of outer surface 176 of intermediate member 156.

Additionally, as shown in FIGS. 4 and 6, outer surface 176 of intermediate member 156 can include a second recess 234 that receives first portion 212 of second stiffener 190. Also, outer surface 176 of intermediate member 156 can include a third recess 236 that receives first portion 222 of third stiffener 192. In some embodiments, second recess 234 and third recess 236 can be substantially filled by second stiffener 190 and third stiffener 192, respectively. Also, outer surface 208 of second stiffener 190 and outer surface 220 of third stiffener 192 can be substantially flush with surrounding portions of outer surface 176 of intermediate member 156.

It will be appreciated that because first stiffener 188, second stiffener 190, and third stiffener 192 can be exposed and substantially flush with outer surface 176 of intermediate member 156, side exterior surface 157 of sole structure 114 can appear substantially smooth and continuous. As such, sole structure 114 can be more aerodynamic. Also, sole structure 114 can be more aesthetically pleasing. Moreover, it will be appreciated that first recess 232, second recess 234, and third recess 236 can further reduce weight of footwear 110. Furthermore, first recess 232, second recess 234, and third recess 236 can provide visual indication of where to place first stiffener 188, second stiffener 190, and third stiffener 192, respectively. As such, first recess 232, second recess 234, and third recess 236 can facilitate assembly of footwear 110.

It will also be appreciated that intermediate member 156 can facilitate attachment of stiffeners 158 to upper 112. For example, external surface 150 of upper 112 can be relatively rough, bumpy, or otherwise irregular, for example, where upper 112 includes knitted component 146. However, intermediate member 156 can be disposed between stiffeners 158 and this irregular external surface 150. Also, outer surface 176 of intermediate member 156 can be much smoother than external surface 150 of upper 112. As such, stiffeners 158 can readily and securely attach to outer surface 176 of intermediate member 156 to provide stiffness to footwear 110.

Also, flexure of upper 112 is unlikely to cause delamination of stiffeners 158 from footwear 110. This is because upper 112 can flex causing intermediate member 156 to resiliently flex. Intermediate member 156 can attenuate and distribute loads due to this flexure, allowing stiffeners 158 to remain securely attached to intermediate member 156. Stated differently, upper 112 can have a first stiffness, intermediate member 156 can have a second stiffness, and stiffeners 158 can have a third stiffness. The third stiffness can be greater than the second stiffness, and the second stiffness can be greater than the first stiffness. Thus, an input force can be applied to upper 112 along lower periphery 119, causing upper 112 to flex. Intermediate member 156 can also flex somewhat and can also attenuate the input force. Stiffeners 158 can remain substantially rigid and may not flex due to the input force. Stiffeners 158 are unlikely to delaminate from intermediate member 156, however, because of the attenuation and distribution of the input force by the intermediate member 156. Also, because intermediate member 156 has some flexibility, upper 112 can maintain some degree of flexibility where attached to intermediate member 156, rather than being substantially rigid, thereby providing more comfort to the wearer.

Figure 3:
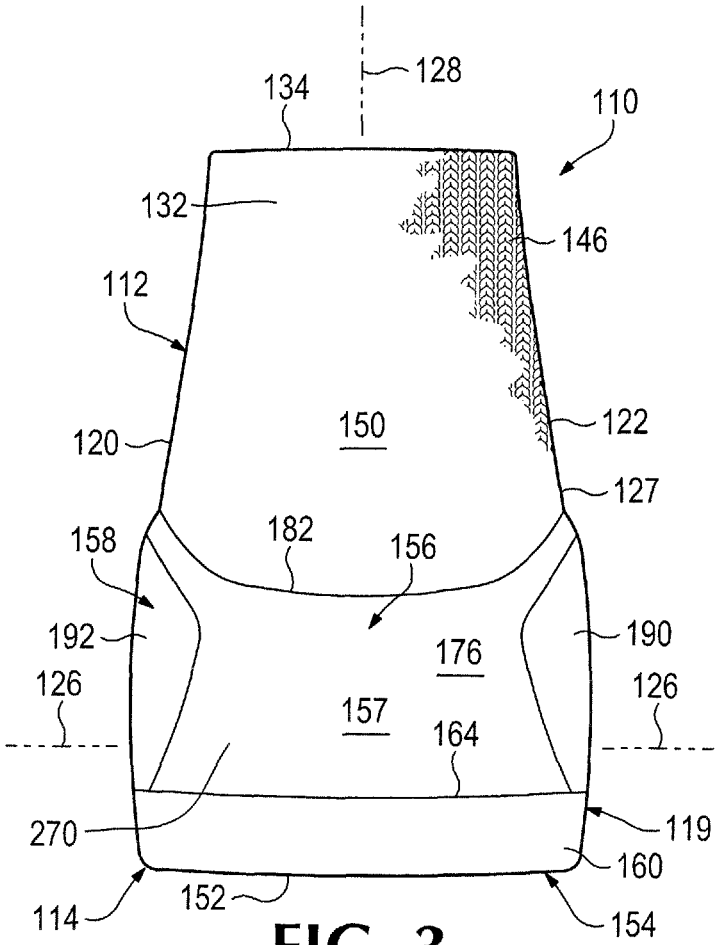
FIG. 3 is a rear view of the article of footwear of FIG. 1.

Furthermore, it will be appreciated that sole structure 114 can include a plurality of stiffeners 158 that are spaced apart from each other. As such, stiffeners 158 can be located in areas that are subject to high loading to increase strength and stiffness in those areas. Furthermore, areas of sole structure 114 between stiffeners 158 can remain relatively flexible to allow sole structure 114 to flex with movements of the wearer's foot. For example, as shown in FIG. 3, an exposed portion 270 of intermediate member 156 can be defined at heel portion 118 between second stiffener 190 and third stiffener 192. Footwear 110 can be more flexible at exposed portion 270 as compared with areas that include second stiffener 190 and third stiffener 192. This can allow footwear 110 to flex more in certain areas as compared to other areas for added comfort, support, and performance.

Additionally, it will be appreciated that stiffeners 158 can be relatively small, thin, and lightweight. Accordingly, stiffeners 158 can increase stiffness and strength of sole structure 114 without significantly increasing weight of sole structure 114.

The shape and position of stiffeners 158 relative to other portions of footwear 110 can provide additional advantages. For example, because stiffeners 158 can extend over upper 112 and also extend underneath the wearer's foot, stiffeners 158 can help interconnect upper 112 and base member 154 while providing stiffness to both. Also, the three dimensional curvature of stiffeners 158 can increase stiffness without the need to significantly increase weight of footwear 110.

Stiffeners 158 can also help the wearer to run, jump, and otherwise move more efficiently. Also, stiffeners 158 can maintain the wearer's foot over the base member 154 of sole structure 114.

Figure 12:
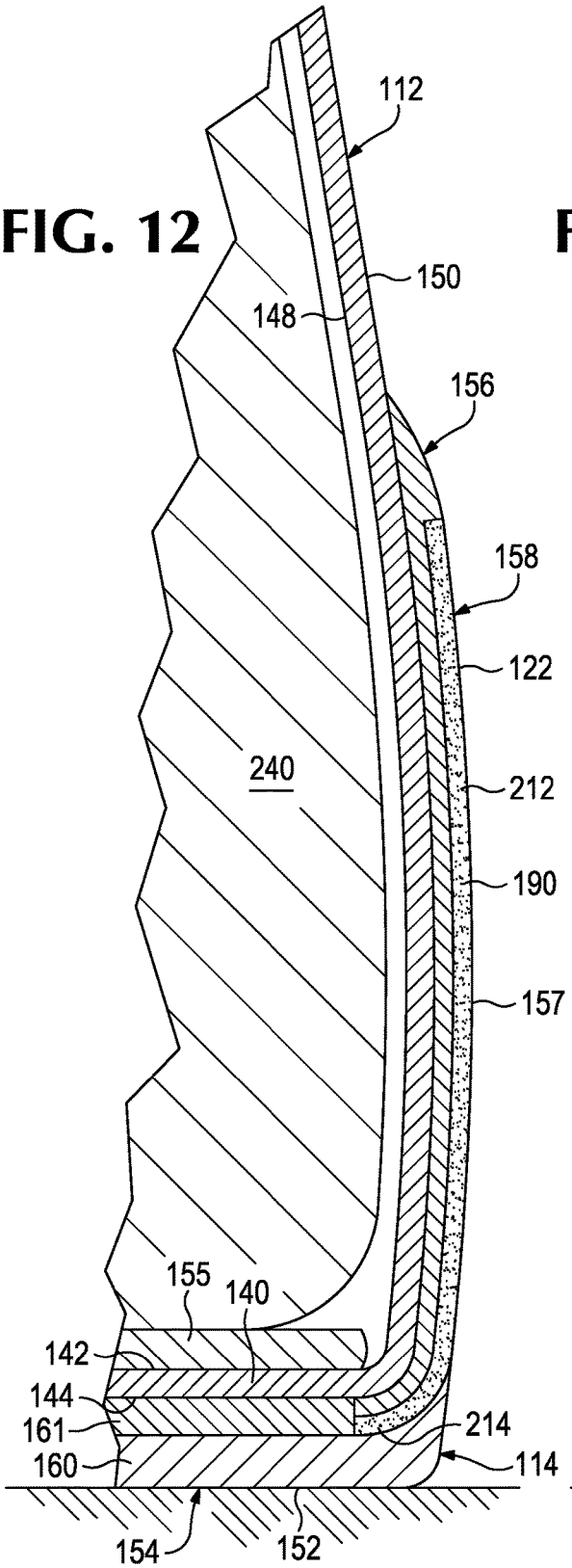
FIG. 12 is a section view of a heel portion of the article of footwear and the wearer's foot.
Figure 13:
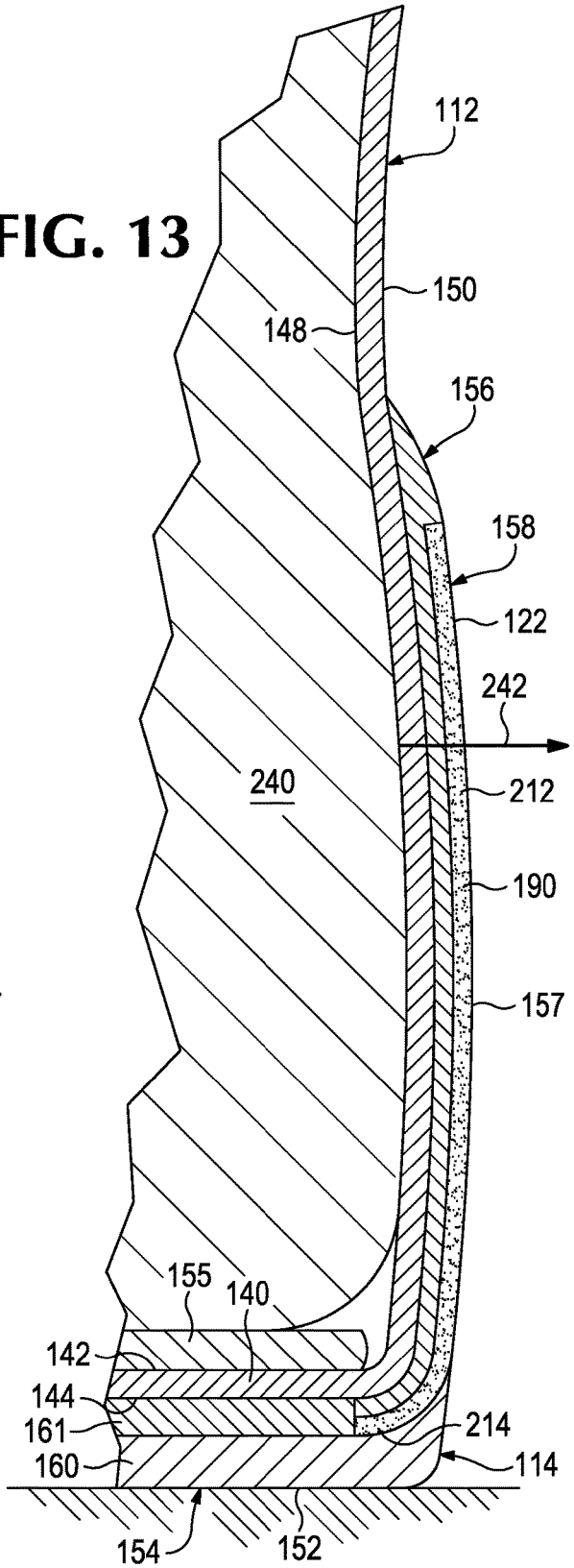
FIG. 13 is a section view of the heel portion of the article of footwear, wherein the foot is pushing laterally against the heel portion.

For example, as shown in FIG. 12, second stiffener 190 is shown in cross section. The wearer's foot 240 is shown in a neutral position and spaced away from internal surface 148 of upper 112. As shown in FIG. 13, foot 240 has shifted laterally and into abutment with internal surface 148. This can occur, for example, when wearer is cutting, shifting, or otherwise attempting to move sideways. As such, foot 240 can push against internal surface 148 and apply a lateral input force through footwear 110 as represented by arrow 242 in FIG. 13. Second stiffener 190 can resist bending under these conditions. Accordingly, foot 240 can push off second stiffener 190 and energy is unlikely to be absorbed by stiffener 190. Also, because second stiffener 190 resists bending, second stiffener 190 can maintain foot 240 over base member 154. Thus, wearer can more effectively and quickly shift laterally. It will be appreciated that third stiffener 192 can function similar to the second stiffener 190 as shown in FIG. 13, for example, when the wearer is shifting in the opposite direction.

Figure 14:
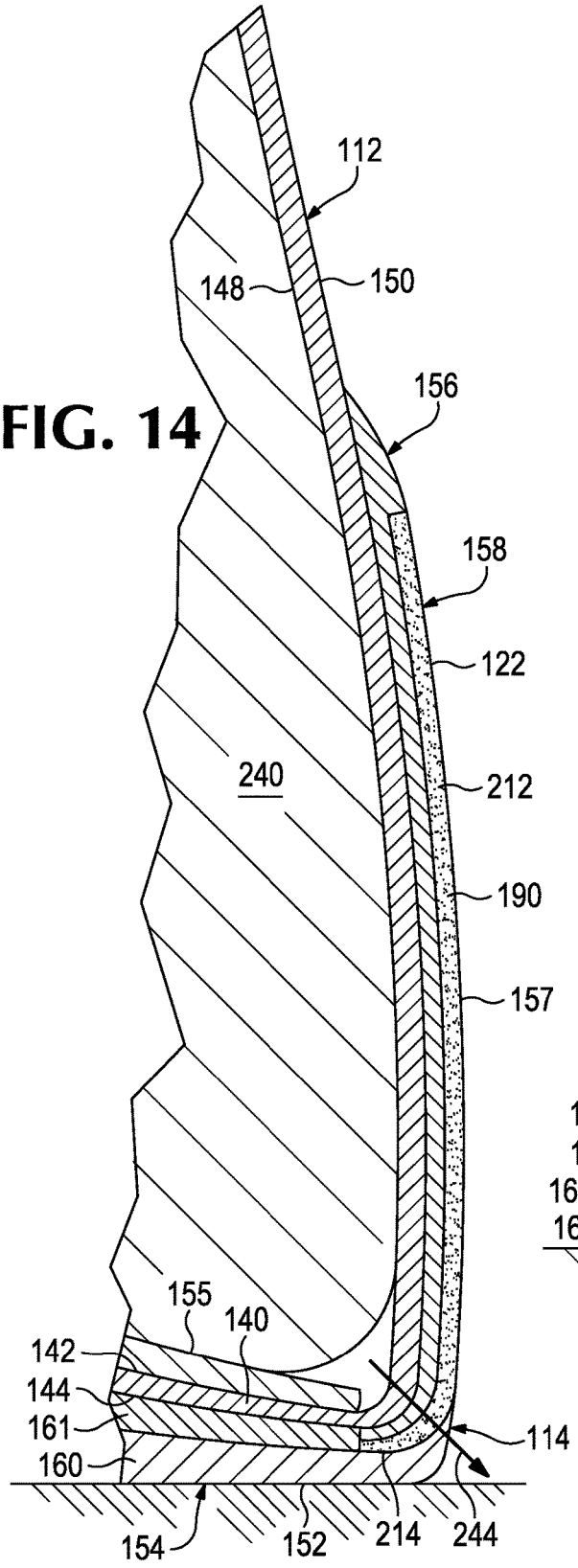
FIG. 14 is a section view of the heel portion of the article of footwear, wherein the foot is pushing downward and laterally against the heel portion.

Moreover, as shown in FIG. 14, the wearer's foot 240 can push against footwear 110 along a different load path. For example, foot 240 can push against footwear 110 along a vector directed downward and laterally as indicated by arrow 244. This can occur, for example, when landing after a jump. However, as shown, second stiffener 190 can substantially resist bending. This can help maintain the wearer's foot 240 over base member 154. Accordingly, shock or other loads can be attenuated by base member 154. Again, it will be appreciated that third stiffener 192 can function similar to second stiffener 190 when subjected to similar loads.

Furthermore, as shown in FIGS. 15 through 17, first stiffener 188 can provide similar benefits. Foot 240 is shown in a neutral position and spaced slightly from internal surface 148 in FIG. 15. Then, when foot 240 shifts laterally and applies a load as indicated by arrow 250 in FIG. 16, first stiffener 188 can resist bending. Accordingly, foot 240 can push off more effectively, and first stiffener 188 can maintain foot 240 over base member 154. Likewise, when foot 240 applies a load downward and laterally as indicated by arrow 252 in FIG. 17, first stiffener 188 can resist bending. Accordingly, first stiffener 188 can maintain foot 240 over base member 154. This can allow base member 154 to attenuate shock or other loads.

In the examples illustrated in FIGS. 12-17 and discussed above, loads are transferred through footwear 110 primarily laterally along transverse axis 126. However, it will be appreciated that loads can transferred along longitudinal axis 124 of footwear 110, and intermediate member 156 and stiffeners 158 can similarly provide support. For example, if the wearer's foot shifts along longitudinal axis 124 toward heel portion 118, the wearer's foot can apply a longitudinal input force to heel portion 118. Heel portion 118 of upper 112 and intermediate member 156 can flex and can attenuate this force. Also, second stiffener 190 and third stiffener 192 can substantially resist bending or other flexure and can provide a reaction force in the opposite direction to maintain the wearer's foot over the base member 154 of sole structure 114.

Therefore, in summary, footwear 110 can include several features that provide additional stiffness to certain areas. This can help support the wearer's foot 240 and facilitate ambulatory movement of the wearer. Also, footwear 110 can be lightweight to further increase the wearer's jumping, running, or other activities.

The foregoing description of the embodiments has been provided for purposes of illustration and description. It is not intended to be exhaustive or to limit the present disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the present disclosure, and all such modifications are intended to be included within the scope of the present disclosure.

What is claimed is:

1. An article of footwear comprising:

an upper that includes a knitted component formed of unitary knit construction, the knitted component including an external surface; and a sole structure that is coupled to the upper, the sole structure including:

an intermediate member with a first surface, the first surface being attached to the external surface of the knitted component, a first stiffener located in at least one of a midfoot region and a forefoot region, the first stiffener having a first portion that is attached to the intermediate member, the first portion having a vertical height, and a second portion that extends a horizontal length from the first portion such that the first stiffener has a generally L-shaped cross-section, wherein the vertical height of the first portion extends from a junction with the second portion to a first terminal end and wherein the second portion extends from the junction with the first portion and terminates at a second terminal end, and wherein the first terminal end is separated from the junction by a greater distance than the second terminal end is separated from the junction;

wherein the intermediate member is disposed between the first stiffener and the external surface of the knitted component; and a base member including an upper surface, wherein the upper surface of the base member includes a base recess and wherein the base recess is recessed into the upper surface of the base member and is configured to receive the second portion of the first stiffener therein.

2. The article of footwear of claim 1, wherein the intermediate member further includes a second surface that faces away from the external surface of the knitted component, and wherein the first stiffener is attached to the second surface of the intermediate member.

3. The article of footwear of claim 1, wherein the second portion includes an inner surface that generally faces the upper and an outer surface that generally faces the base member, and wherein the outer surface is attached to the base member.

4. The article of footwear of claim 2, wherein the second surface of the intermediate member includes a recess, and the second surface of the intermediate member includes a portion that is adjacent the recess, wherein the first stiffener includes an exterior surface, and wherein the exterior surface is substantially flush with the adjacent portion.

5. The article of footwear of claim 1, wherein the upper includes a heel portion, a medial side, and a lateral side, wherein the sole structure further comprises a medial stiffener and a lateral stiffener, wherein the medial stiffener is disposed at the heel portion on the medial side, wherein the lateral stiffener is disposed at the heel portion on the lateral side, and wherein the intermediate member is exposed between the medial stiffener and the lateral stiffener.

6. The article of footwear of claim 1, wherein the upper includes a midfoot portion and a lateral side, and wherein the first stiffener is disposed at the midfoot portion on the lateral side.

7. The article of footwear of claim 1, wherein the first stiffener has a three-dimensionally curved surface.

8. The article of footwear of claim 1, wherein the upper has a first stiffness, the intermediate member has a second stiffness, and the first stiffener has a third stiffness, wherein the third stiffness is greater than the second stiffness, and wherein the second stiffness is greater than the first stiffness.

9. An article of footwear comprising:

an upper with a first wall and a second wall, the first wall and the second wall being separated at a distance from each other to at least partially define a void that is configured to receive a foot; and a sole structure having a heel portion, a midfoot portion, and a forefoot portion extending along a longitudinal axis, the sole structure coupled to the upper and including:

at least one stiffener with a generally vertically oriented first portion and a generally horizontally oriented second portion, wherein the at least one stiffener is located longitudinally forward of the heel portion, wherein the first portion extends from a junction with the second portion to a first terminal end and wherein the second portion extends from the junction with the first portion and terminates at a second terminal end, and wherein the second terminal end is located between a lateral side and a medial side of the sole structure;

an intermediate member with a first surface and a second surface, the first surface being attached to the upper, the second surface facing away from the first surface, the second surface including an intermediate recess, the intermediate recess being configured to receive the correspondingly-shaped first portion of the at least one stiffener, the first portion of the at least one stiffener being attached to the intermediate member, and a base member that extends between the first wall and the second wall of the upper, the base member including an upper surface facing the upper and a ground engaging surface, and wherein the upper surface of the base member includes a base recess, wherein the base recess is recessed into the upper surface of the base member and is configured to receive the second portion of the at least one stiffener.

10. The article of footwear of claim 9, wherein the second portion of the at least one stiffener is attached to the upper surface of the base member.

11. The article of footwear of claim 9, wherein the second portion of the at least one stiffener includes an inner surface, wherein the upper surface of the base member includes a portion that is adjacent the base recess, and wherein the inner surface of the at least one stiffener is substantially flush with the adjacent portion of the upper surface of the base member.

12. The article of footwear of claim 9, wherein the base member includes an outsole and a base pad, wherein the base pad is disposed between the outsole and the upper, wherein the outsole defines the ground engaging surface, wherein the base pad includes a lower surface that is attached to the outsole, and wherein the base pad defines the upper surface with the base recess.

13. The article of footwear of claim 9, wherein the upper includes a knitted component formed of unitary knit construction, the knitted component including an external surface, the first surface of the intermediate member being attached to the external surface of the knitted component.

14. The article of footwear of claim 9, wherein the at least one stiffener includes an outer surface, and wherein the outer surface is substantially flush with a portion of the second surface of the intermediate member that is adjacent the intermediate recess.

15. An article of footwear comprising: an upper; and a sole structure that is coupled to the upper, the sole structure including: an intermediate member with a first surface and a second surface, the first surface being attached to the upper, the second surface facing away from the upper, a first stiffener located on only one of a lateral side and a medial side of the article of footwear, the first stiffener including a first inner surface and a first outer surface, the first inner surface being attached to the second surface of the intermediate member, the first outer surface facing away from the intermediate member, and a second stiffener located on the other of only one of a lateral side and a medial side of the article of footwear, the second stiffener including a second inner surface and a second outer surface, the second inner surface being attached to the second surface of the intermediate member, the second outer surface facing away from the intermediate member, the first stiffener and the second stiffener being separate distinct structures that are spaced apart and detached from each other, the intermediate member including an exposed portion that is exposed between the first stiffener and the second stiffener, and a third stiffener being a separate distinct structure that is spaced apart and detached from the first and second stiffeners, the third stiffener including a generally vertically oriented first portion and a generally horizontally oriented second portion, wherein the first portion of the third stiffener extends from a junction with the second portion to a first terminal end and wherein the second portion extends from the junction with the first portion and terminates at a second terminal end, and wherein the second terminal end terminates before a midline extending between a forefoot and a heel of the article of footwear, and wherein the intermediate member comprises an intermediate recess that is correspondingly shaped to the first portion of the third stiffener and wherein the intermediate recess is configured to receive the first portion of the third stiffener therein and, a base member including an upper surface facing the upper, wherein the upper surface of the base member includes a base recess and wherein the base recess is recessed into the upper surface of the base member and is configured to receive the second portion of the third stiffener therein.

16. The article of footwear of claim 15, wherein the upper includes a heel portion, a medial side, and a lateral side, wherein the first stiffener is disposed at the heel portion on the lateral side, wherein the second stiffener is disposed at the heel portion on the medial side, and wherein the exposed portion of the intermediate member is exposed at the heel portion between the medial side and the lateral side.

17. The article of footwear of claim 16, wherein the upper further includes a midfoot portion, and wherein the third stiffener is disposed at the midfoot portion on the lateral side.

18. The article of footwear of claim 15, wherein the upper includes a knitted component formed of unitary knit construction, the knitted component including an external surface, the first surface of the intermediate member being attached to the external surface of the knitted component.

19. The article of footwear of claim 9, wherein the first portion of the at least one stiffener comprises an outer surface and wherein the outer surface of the at least one stiffener is substantially flush with the second surface of the intermediate member.

20. The article of footwear of claim 9, wherein the base member extends along a longitudinal axis between a first end located in the heel region and a second end opposite the first end, and wherein the base recess is formed in the upper surface of the base member at a location adjacent the second end.

* * * * *